US007701407B2

(12) United States Patent
Kanno et al.

(10) Patent No.: US 7,701,407 B2
(45) Date of Patent: Apr. 20, 2010

(54) WIDE-BAND SLOT ANTENNA APPARATUS WITH STOP BAND

(75) Inventors: Hiroshi Kanno, Osaka (JP); Tomoyasu Fujishima, Kanagawa (JP)

(73) Assignee: Panasonic Corporation, Osaka (JP)

( * ) Notice: Subject to any disclaimer, the term of this patent is extended or adjusted under 35 U.S.C. 154(b) by 203 days.

(21) Appl. No.: 12/116,754

(22) Filed: May 7, 2008

(65) Prior Publication Data

US 2008/0284670 A1 Nov. 20, 2008

(30) Foreign Application Priority Data

May 8, 2007 (JP) ..... 2007-123206

(51) Int. Cl.
*H01Q 13/10* (2006.01)

(52) U.S. Cl. ..... 343/767

(58) Field of Classification Search ..... 343/767, 343/768, 770, 700 MS, 846
See application file for complete search history.

(56) References Cited

U.S. PATENT DOCUMENTS 6,445,906 B1 * 9/2002 Nguyen et al. ..... 455/73
6,864,848 B2 * 3/2005 Sievenpiper ..... 343/767
7,132,992 B2 * 11/2006 Mori ..... 343/770
2007/0164918 A1 7/2007 Kanno et al.

FOREIGN PATENT DOCUMENTS

JP 2003-273638 9/2003
JP 2004-336328 11/2004
JP 4050307 12/2007

OTHER PUBLICATIONS

L. Zhu et al., "A Novel Broadband Microstrip-Fed Wide Slot Antenna with Double Rejection Zeros", IEEE Antennas and Wireless Propagation Letters, vol. 2, pp. 194-196, 2003.
H. R. Chuang et al., "A Printed UWB Triangular Monopole Antenna" Microwave Journal, vol. 49, No. 1, Jan. 2006.

* cited by examiner

*Primary Examiner*—Hoang V Nguyen
(74) *Attorney, Agent, or Firm*—Wenderoth, Lind & Ponack, L.L.P.

(57) ABSTRACT

A slot antenna apparatus includes a grounding conductor having an outer edge including a first portion facing a radiation direction and a second portion other than the first portion, a one-end-open feed slot formed in the grounding conductor along the radiation direction such that an open end is provided at a center of the first portion, and a feed line including a strip conductor close to the grounding conductor and intersecting with the feed slot at at least a part thereof to feed a radio frequency signal to the feed slot. The slot antenna apparatus further comprises at least one one-end-open parasitic slot having an electrical length equivalent to one-quarter effective wavelength in a certain stop band, the parasitic slot having an open end at the second portion, and being formed in the grounding conductor so as not to intersect with the feed line.

5 Claims, 29 Drawing Sheets

PRIOR ART

WIDE-BAND SLOT ANTENNA APPARATUS WITH STOP BAND

BACKGROUND OF THE INVENTION

1. Field of the Invention

The present invention relates to an antenna apparatus for transmitting and receiving analog radio frequency signals or digital signals in a microwave band, a millimeter-wave band, etc. More particularly, the present invention relates to a slot antenna apparatus operable in a wideband and having stop bands.

2. Description of the Related Art

A wireless device operable in a much wider band than that of prior art devices is required for the following two reasons. As the first reason, it is intended to implement a novel short-range wireless communication system with the authorization of use of a very wide frequency band, i.e., an ultra-wideband (UWB) wireless communication system. As the second reason, it is intended to utilize a variety of communication systems each using different frequencies, by means of one terminal.

For example, when converting a frequency band into a fractional bandwidth being normalized by a center frequency fc of an operating band, a frequency band from 3.1 GHz to 10.6 GHz authorized for UWB in U.S. corresponds to a value of 109.5%, indicating a very wide band. On the other hand, in cases of a patch antenna and a one-half effective wavelength slot antenna which are known as basic antennas, the operating bands converted to fractional bandwidths are less than 5% and less than 10%, respectively, and thus, such antennas cannot achieve a wideband property such as that of UWB. For example, referring to the frequency bands currently used for wireless communications in the world, a fractional bandwidth to the extent of 30% should be achieved in order to cover bands from the 1.8 GHz band to the 2.4 GHz band with one same antenna, and similarly, a fractional bandwidth to the extent of 90% should be achieved in order to simultaneously cover the 800 MHz band and the 2 GHz band with one same antenna. Furthermore, in order to simultaneously cover bands from the 800 MHz band to the 2.4 GHz band, a fractional bandwidth of 100% or more is required. The more the number of systems simultaneously handled by one same terminal increases, thus resulting in the extension of a frequency band to be covered, the more a wideband antenna with small size is required to be implemented.

A one-end-open one-quarter effective wavelength slot antenna is one of the most basic planar antennas, and a schematic view of this antenna is shown in FIGS. 31A, 31B, and 31C (hereinafter, referred to as a "first prior art example"). FIG. 31A is a schematic top view showing a structure of a typical one-quarter effective wavelength slot antenna (showing a grounding conductor 103 on a backside by phantom), FIG. 31B is a schematic cross-sectional view along the dashed line in FIG. 31A, and FIG. 31C is a schematic view showing a structure of the backside of the slot antenna in FIG. 31A by phantom. As shown in FIGS. 31A, 31B, and 31C, a feed line 113 is provided on a front-side of a dielectric substrate 101, and a notch with a width Ws and a length Ls is formed in a depth direction 109*a* from an outer edge 105*a* of an infinite grounding conductor 103 provided on a backside thereof. The notch operates as a slot resonator 111, one of its ends is opened at an open end 107. The slot 111 is a circuit element which is obtained by completely removing a conductor in thickness direction, in a partial region of the grounding conductor 103, and which resonates near a frequency fs at which one-quarter of the effective wavelength is equivalent to the slot length Ls. The feed line 113 formed in a width direction 109*b* intersects with the slot 111 at a portion thereof, and electromagnetically excites the slot 111. A connection to an external circuit is established through an input terminal. Note that according to common practice, a distance Lm of the feed line 113 from its open-ended termination point 119 to the slot 111 is set to the extent of one-quarter effective wavelength at the frequency fs, so as to achieve input impedance matching. Further, note that according to common practice, a line width W1 is designed based on a thickness H of the substrate and a permittivity of the substrate, such that the characteristic impedance of the feed line 113 is set to 50Ω.

As shown in FIGS. 32A, 32B, and 32C, Patent Document 1 discloses a structure for operating the one-quarter effective wavelength slot antenna shown in the first prior art example, at a plurality of resonant frequencies (hereinafter, referred to as a "second prior art example"). A slot 111 has a slot length Ls, and includes a capacitor 16 so as to connect points 16*a* and 16*b* each located a distance Ls2 away from an open end. When the antenna is excited at a plurality of resonant frequencies at a feeding point 15, the antenna operates with different slot lengths Ls and Ls2 as shown in FIGS. 32B and 32C, and thus the bandwidth can be extended. However, according to the frequency characteristics shown in Patent Document 1, it is not enough to obtain a currently required ultra-wideband characteristics.

Non-Patent Document 1 discloses a method of operating a slot resonator in a wideband, which is short-circuited at both ends of a slot, and is of a one-half effective wavelength slot antenna (hereinafter, referred to as the "third prior art example"). FIG. 33 is a schematic top view showing a structure of a slot antenna described in Non-Patent Document 1. In FIG. 33, a grounding conductor 103 and a slot 111 on a backside of a substrate are shown by phantom. The slot 111 is formed in the grounding conductor 103, such that the slot 111 has a certain width Ws, and a length Ls equivalent to one-half effective wavelength, and such that the slot 111 is coupled to a feed line 113 at a position 51*a* which is offset by a distance d from the center of the slot 111. According to prior art methods for matching input impedance of a slot antenna, a method has been used in which for exciting the slot 111, the feed line 113 intersects with the slot 111 at a position on the feed line 113 apart from an open-ended termination point 119 by one-quarter effective wavelength at a frequency fs. However, as shown in FIG. 33, in the third prior art example, a region extending over a distance Lind from the open-ended termination point 119 of the feed line 113 is replaced by an inductive region 121 which is a transmission line with a characteristic impedance higher than 50Ω, and that inductive region 121 is coupled to the slot 111 at substantially the center of the inductive region 121 (i.e., in FIG. 33, t1 and t2 are substantially equal to each other). In this case, a width W2 of the inductive region 121 is set to a certain width narrower than the width of the feed line 113, the length Lind of the inductive region 121 is set to one-quarter effective wavelength at a center frequency f0 of an operating band, and the inductive region 121 operates as a one-quarter wavelength resonator different from the slot resonator. As a result, an equivalent circuit structure includes two resonators, which is increased from one resonator that is included in a typical slot antenna, and a double-resonance operation is achieved by coupling the resonators resonating at frequencies close to each other. In an example shown in FIG. 2(*b*) of Non-Patent Document 1, a good reflection impedance characteristic of −10 dB or less is achieved at a fractional bandwidth of 32% (near 4.1 GHz to near 5.7 GHz). As shown in comparison of actual measurement results of reflection characteristics versus frequency in FIG. 4 of Non-Patent Document 1, the fractional bandwidth of the antenna of the third prior art example is much wider than a fractional bandwidth of 9% of a typical slot antenna fabricated under conditions using the same substrate.

Further, in Non-Patent Document 2 shown as a fourth prior art example, a printed monopole antenna as one type of monopole antennas, known by its wideband operation, is successfully operated with low reflection in the UWB band. However, as is clearly seen from an E-plane radiation pattern shown in FIG. 5(b) of Non-Patent Document 2, the main beam direction greatly changes depending on frequency. In addition, the half-width of the main beam in the E-plane also greatly varies depending on frequency.

In Patent Document 2 shown in FIG. 34 as a fifth prior art example, a printed monopole antenna itself is provided with a band-stop filter function. This aims to avoid interference between systems because, although a wide frequency band is assigned to a UWB system, existing wireless systems are already operating in parts of the band. Particularly, in Europe and Japan, it is unauthorized by regulation to output UWB signals in the 5 GHz band used for wireless LANs, and thus, it is necessary to deal with this regulation. On the other hand, since it is difficult to implement a ultra-wideband filter for a GHz band with small size, a band-stop function is required to be provided for an antenna itself. In the fifth prior art example, a radiation conductor 2 as a printed monopole is provided above a grounding conductor plate 1, and a ground feeding point 1f and a signal feeding point 2f are positioned, respectively, at a location where the grounding conductor plate 1 and the radiation conductor 2 are close to each other. In this case, one-end-open slot resonators NR and NL, each having a width Nh and a length Nd and having one-quarter effective wavelength in a stop band, are configured at an outer edge portion of the radiation conductor 2 as the printed monopole, thus achieving the band-stop function.

Prior art documents related to the present invention are as follows:

(1) Patent Document 1: Japanese Patent Laid-Open Publication No. 2004-336328;

(2) Patent Document 2: Japanese Patent Laid-Open Publication No. 2003-273638;

(3) Non-Patent Document 1: L. Zhu, et al., "A Novel Broadband Microstrip-Fed Wide Slot Antenna With Double Rejection Zeros", IEEE Antennas and Wireless Propagation Letters, Vol. 2, pp. 194-196, 2003; and (4) Non-Patent Document 2: H. R. Chuang, et al., "A Printed UWB Triangular Monopole Antenna", Microwave Journal, Vol. 49, No. 1, January 2006.

As discussed above, sufficient wide band operation has not been achieved in the prior art slot antennas. Although the printed monopole antenna, which is expected as a wideband antenna for UWB, can operate with low reflection in an ultra-wideband and also achieves the band-stop function in parts of the band, it is difficult to maintain the main beam direction in an operating band. As a result, even when such an antenna is applied to a UWB system, it is difficult to cover a communication area.

First of all, in the case of a typical one-end-open slot antenna with only one resonator in its configuration as in the first prior art example, a frequency band, where a good reflection impedance characteristic can be achieved, is limited to a fractional bandwidth to the extent of a little less than 10%.

In the second prior art example, although a wideband operation is achieved by incorporating a capacitive reactance element into a slot, it can be readily noticed that additional components such as a chip capacitor are required, and the characteristics of the antenna vary depending on variations in characteristics of the newly incorporated additional components. Further, according to the examples disclosed in FIGS. 13 and 19 of Patent Document 1, it is difficult to achieve a characteristic of input impedance matching with low reflection in an ultra-wideband.

In the third prior art example, the fractional bandwidth characteristic is limited to the extent of 35%. Further, as compared to the antennas of the first and second prior art examples with one-end-open slot resonators which are of one-quarter effective wavelength resonators, it is disadvantageous in reducing size to use a slot resonator which is short-circuited at both ends and is of a one-half effective wavelength resonator.

In the fourth prior art example, although the low-reflection characteristic is achieved over the entire UWB band, the radiation characteristics considerably vary in the band. Referring to a radiation pattern diagram in FIG. 5(b) of Non-Patent Document 2, the gain in a 225-degree direction decreases by 6 dB at 5 GHz, and by as much as 15 dB at 7 GHz, as compared to a reference gain value at 4 GHz. This phenomenon results from the fact that the main beam direction varies depending on frequency, and the higher the frequency increases, the lower the half-width of the main beam decreases. Thus, it is extremely difficult to stably establish communication conditions over the entire band.

In the fifth prior art example, although the band-stop function in a partial band is achieved in a printed monopole antenna, the stable radiation characteristics in the band cannot be expected, since the structure of the fifth prior art example is the same in principle as that of the fourth prior art example.

SUMMARY OF THE INVENTION

An object of the present invention is to solve the above-described problems of prior arts, and to provide a small-sized wideband slot antenna apparatus which is configured based on a one-end-open slot antenna apparatus, and which can operate in a wider band than prior art apparatuses, maintain a main beam direction in one same direction across an operating band, and achieve a band-stop function in a partial band.

According to an aspect of the present invention, a slot antenna apparatus includes a grounding conductor having an outer edge including a first portion facing a radiation direction and a second portion other than the first portion, a one-end-open feed slot formed in the grounding conductor along the radiation direction such that an open end is provided at a center of the first portion of the outer edge of the grounding conductor, and a feed line including a strip conductor close to the grounding conductor and intersecting with the feed slot at least a part thereof to feed a radio frequency signal to the feed slot. The feed line is branched at a first point near the feed slot into a group of branch lines including at least two branch lines, and at least two branch lines among the group of branch lines are connected to each other at a second point near the feed slot and different from the first point, and thus forming at least one loop wiring line on the feed line. A maximum value of respective loop lengths of the at least one loop wiring line is set to a length less than one effective wavelength at an upper limit frequency of an operating band. Branch lengths of all those branch lines among the group of branch lines, each branch line terminated at an open end and not forming a loop wiring line, are less than one-quarter effective wavelength at the upper limit frequency of the operating band. The slot antenna apparatus further includes at least one one-end-open parasitic slot having an electrical length equivalent to one-quarter effective wavelength in a certain stop band, the parasitic slot having an open end at the second portion of the outer edge of the grounding conductor, and being formed in the grounding conductor so as not to intersect with the feed line.

In the above-described slot antenna apparatus, each loop wiring line intersects with boundaries between the feed slot and the grounding conductor, and the feed slot is excited at two or more points at which the boundaries intersect with the loop wiring line and which have different distances from the open end of the feed slot.

Moreover, in the above-described slot antenna apparatus, the feed line is terminated at an open end. A region of the feed line, extending from the open end over a length of one-quarter effective wavelength at a center frequency of the operating band, is configured as an inductive region with a characteristic impedance higher than 50Ω, and the feed line intersects with the feed slot at substantially a center of the inductive region.

Further, in the above-described slot antenna apparatus, at the first portion of the outer edge of the grounding conductor, distances from the open end of the feed slot to both ends of the first portion of the outer edge are respectively set to a length greater than or equal to one-quarter effective wavelength at a resonant frequency of the feed slot, and thus the grounding conductor operates at a frequency lower than the resonant frequency of the feed slot.

Furthermore, in the above-described slot antenna apparatus, the grounding conductor is configured to be symmetric about an axis parallel to the radiation direction and passing through the feed slot, and the feed line is connected to a feeding point provided on a symmetry axis of the grounding conductor at the second portion of the outer edge of the grounding conductor. By being provided on the symmetry axis of the grounding conductor, the feeding point has an input and output impedance higher than an impedance in an unbalanced mode of the grounding conductor.

As described above, the unbalanced-feed wideband slot antenna apparatus of the present invention not only can achieve a wideband operation which is difficult for prior art slot antenna apparatuses to achieve, but also can maintain a main beam direction across an operating band, and implement a band-stop function to suppress radiation characteristics in a partial band, thus helping to implement a power-saving and high-speed UWB communication system that avoids interference with other communication systems, while efficiently covering desired communication areas.

BRIEF DESCRIPTION OF THE DRAWINGS

Various objects, features, and advantages of the present invention will be disclosed as preferred embodiments which are described below with reference to the accompanying drawings.

DETAILED DESCRIPTION OF THE PREFERRED EMBODIMENTS

Figure 1:
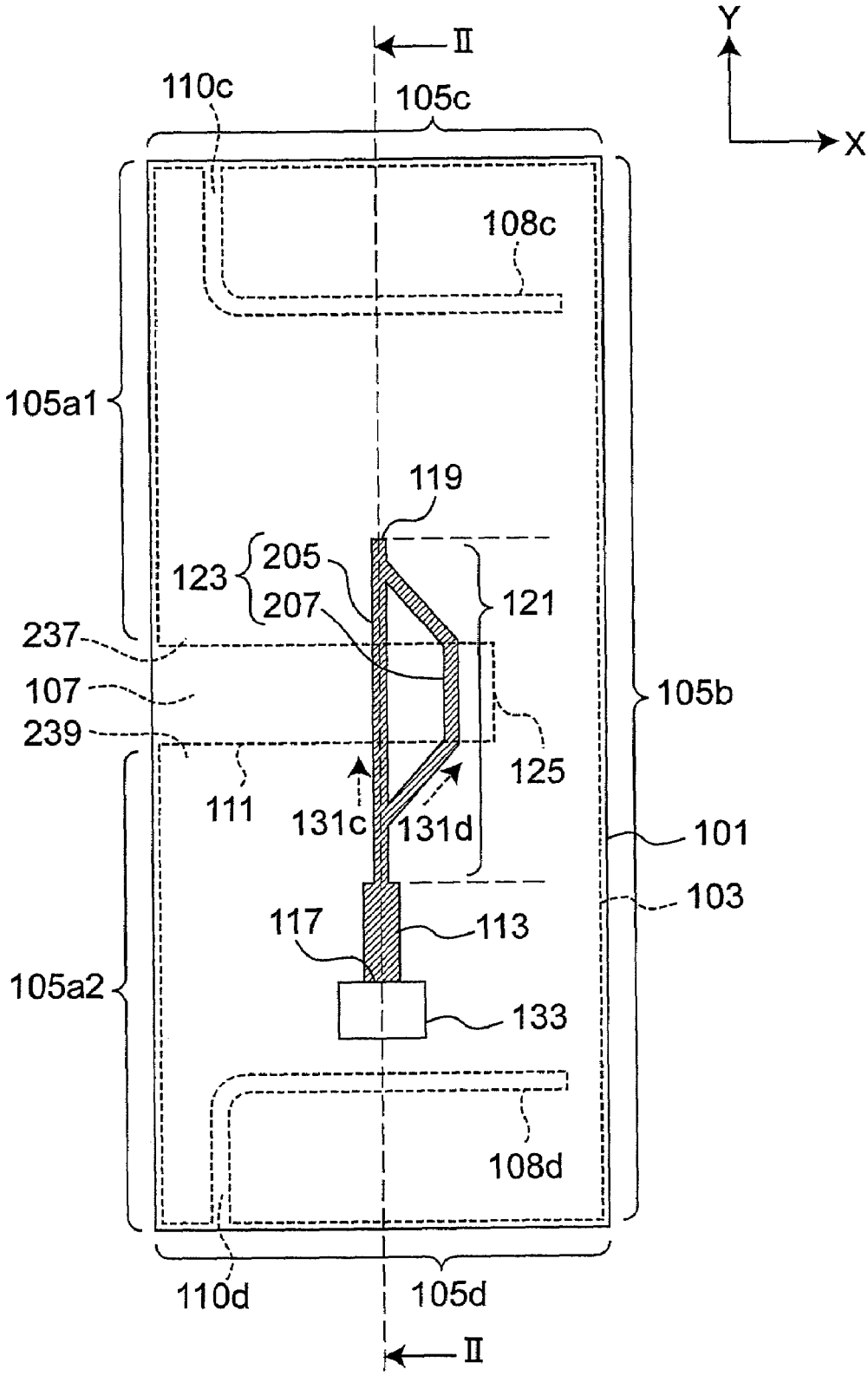
FIG. 1 is a schematic top view showing a structure of an unbalanced-feed wideband slot antenna apparatus according to a first preferred embodiment of the present invention.

Preferred embodiments according to the present invention will be described below with reference to the drawings. Note that in the drawings the same reference numerals denote like components.

First Preferred Embodiment

Figure 2:
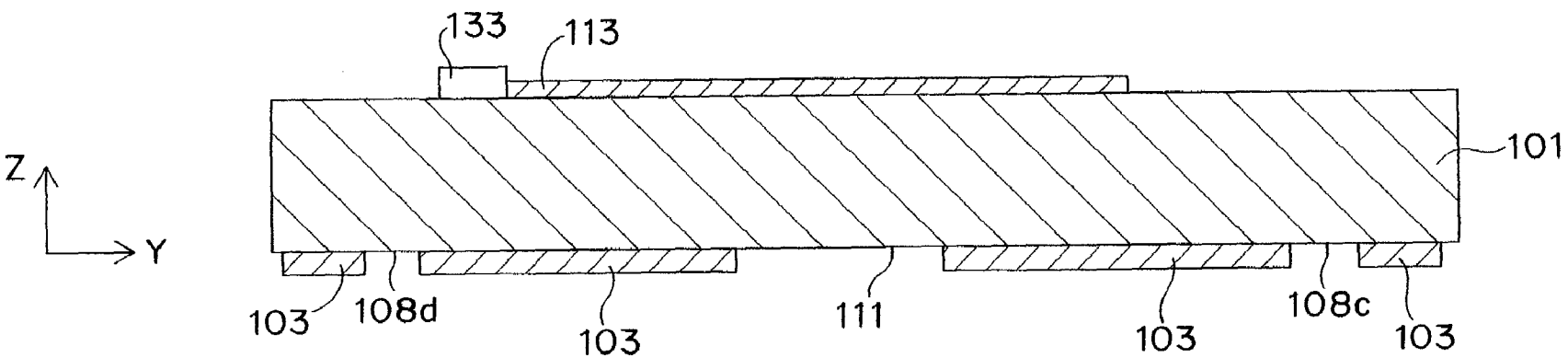
FIG. 2 is a schematic cross-sectional view along the dashed line in FIG. 1.

FIG. 1 is a schematic top view showing a structure of an unbalanced-feed wideband slot antenna apparatus according to a first preferred embodiment of the present invention. FIG. 2 is a schematic cross-sectional view along the dashed line in FIG. 1. In schematic top views of FIG. 1 and others, the structure of a backside of a substrate 101 is shown by phantom (i.e., by dotted lines). For the purpose of explanation, refer to XYZ coordinates as shown in the respective drawings.

The unbalanced-feed wideband slot antenna apparatus according to the preferred embodiment of the present invention is characterized by including: a grounding conductor 103 with an outer edge including a first portion facing a radiation direction (i.e., a −X direction) and a second portion other than the first portion; a one-end-open slot 111 formed in the grounding conductor 103 along the radiation direction such that an open end 107 is provided at the center of the first portion of the outer edge of the grounding conductor 103; and an unbalanced feed line 113 configured with a strip conductor close to the grounding conductor 103 and intersecting with the slot 111 at least a part thereof to feed a radio frequency signal to the slot 111, thus operating in a wider band than that of prior art apparatuses. The unbalanced-feed wideband slot antenna apparatus according to the preferred embodiment of the present invention is characterized by further including one-end-open parasitic slot resonators 108*c* and 108*d*, each having an electrical length equivalent to one-quarter effective wavelength in a certain stop band, each having an open end 110*c*, 110*d* at the second portion of the outer edge of the grounding conductor 103, and each formed in the grounding conductor 103 so as not to intersect with the unbalanced feed line 113.

Referring to FIG. 1, the grounding conductor 103 with a finite area and a certain shape is formed on the backside of the dielectric substrate 101. The grounding conductor 103 is substantially configured in a polygonal shape, including one side at which the one-end-open slot 111 is formed, and a plurality of other sides. In the case of the present preferred embodiment, the grounding conductor 103 is rectangular, and includes sides 105*a*1 and 105*a*2 on the −X side, a side 105*b* on the +X side, a side 105*c* on the +Y side, and a side 105*d* on the −Y side. The rectangular slot 111 with a width Ws and a length Ls is configured by forming a notch on the grounding conductor 103 at about the midpoint on the −X side of the grounding conductor 103 (i.e., the point between the first portion 105*a*1 and the second portion 105*a*2 on the −X side), in a direction orthogonal to the −X side (i.e., +X direction). Accordingly, an end on the −X side of the slot 111 is configured as the open end 107, and an end on the +X side is configured as a short-circuited end 125. The slot 111 operates as a one-end-open feeding slot resonator with one-quarter effective wavelength (slot antenna mode). When assuming that the slot width Ws is negligible as compared with the slot length Ls, a resonant frequency fs of the slot 111 is a frequency at which one-quarter of the effective wavelength is equivalent to the slot length Ls. When such assumption is not valid, the apparatus is configured such that a slot length (Ls×2+Ws)/2 with considering the slot width is equivalent to one-quarter effective wavelength. In each preferred embodiment of the present invention, it is desirable that the resonant frequency fs of the slot 111 is set to the extent of a center frequency fc of an operating frequency band (e.g., 3.1 GHz to 10.6 GHz). On a front-side of the dielectric substrate 101 is formed the unbalanced feed line 113 extending in a direction substantially orthogonal to the slot 111 (i.e., a Y-axis direction), and intersecting with the slot 111 at least a part thereof in overlapping manner. A partial region of the unbalanced feed line 113 is configured as an inductive region 121, as will be described in detail later. The unbalanced feed line 113 is configured as a microstrip line made of the grounding conductor 103, the strip conductor on the front-side of the dielectric substrate 101, and the dielectric substrate 101 therebetween. For ease of explanation in this specification, hereinafter, refer only the strip conductor on the front-side as the unbalanced feed line 113. The main beam direction of radiation from the slot 111 is in a direction from the short-circuited end 125 to the open end 107 of the slot 111 (i.e., the −X direction), and accordingly, in this specification, the −X direction is considered as "forward", the +X direction is considered as "backward", and a Y-axis direction is called as the "width direction" of the unbalanced-feed wideband slot antenna apparatus. Note that this specification defines as a slot, a structure in which a conductor layer forming the grounding conductor 103 is completely removed in a thickness direction. That is, the slot is not a structure just reduced in thickness by scraping a surface of the grounding conductor 103 off in a partial region thereof.

Mounting of Circuit Block 133

In the unbalanced-feed wideband slot antenna apparatus according to the preferred embodiment of the present invention, an arbitrary circuit block 133 having an unbalanced terminal can be further mounted on the antenna substrate. In this case, the unbalanced terminal of the circuit block 133 is connected to an antenna feeding point 117 at one end of the unbalanced feed line 113, and thus an ultra-wideband communication system can be provided that achieves a reduced dimension while feeding in unbalanced manner.

Available components within the arbitrary circuit block 133 having the unbalanced terminal include: filters such as bandpass, band-stop, low-pass, and high-pass filters, a balun, a functional switch, e.g., for changing between transmitting and receiving, a high-power amplifier, an oscillator, a low-noise amplifier, a variable attenuator, an up-converter, a down-converter, etc. Particularly, it is difficult to implement a filter requiring wideband characteristics, by means of a balanced circuit, and thus, it is practical to implement a connecting circuit from the filter to an antenna feed line, by means of an unbalanced circuit. The unbalanced-feed wideband slot antenna apparatus according to the preferred embodiment of the present invention achieves ultra-wideband characteristics while feeding in unbalanced manner. The band-stop characteristics of the unbalanced-feed wideband slot antenna apparatus according to the preferred embodiment of the present invention can relax the requirements for filter bandwidth characteristics to an achievable level.

Grounding Conductor 103 Operating as Dipole Antenna

Next, conditions imposed on the size in the width direction of the grounding conductor 103 will be described. The grounding conductor 103 is the conductor structure with the finite area as described above, and particularly, configured to include on the −X side, the portion 105*a*1 extending in the +Y direction from the open end 107 by a length Wg1, and the portion 105*a*2 extending in the −Y direction from the open end 107 by a length Wg2. In this case, each of the lengths Wg1 and Wg2 of the sides 105*a*1 and 105*a*2 on the −X side is larger than or equal to a length Lsw equivalent to one-quarter effective wavelength at the resonant frequency fs of the slot 111. This condition is desirable for stabilizing antenna radiation characteristics in the slot antenna mode.

By limiting the circuit of the grounding conductor 103 according to the preferred embodiment of the present invention to a finite area, the grounding conductor 103 can also operate in a grounding conductor dipole antenna mode in which the entire grounding conductor structure is used. In either case of the grounding conductor dipole antenna mode, and the slot antenna mode of the slot 111, it is common that a radio frequency current concentrates at the short-circuited end 125 of the slot 111. Thus, the either antenna uses a common circuit board, and at the same time, provides common radiation characteristics in polarization characteristics. Also, each main beam direction of not only radiation in the slot antenna mode but also radiation in the grounding conductor dipole antenna mode is in the −X direction. Thus, if the resonant frequency fd in the grounding conductor dipole antenna mode can be set to be different from, and slightly lower than the resonant frequency fs of the slot 111, the unbalanced-feed wideband slot antenna apparatus according to the preferred embodiment of the present invention can achieve characteristics in which the operating band is dramatically extended to the lower frequency side as compared to the case of using only the slot antenna mode. Since the slot 111 is provided at substantially the center of the grounding conductor 103, the effective length of the resonator in the grounding conductor dipole antenna mode is extended. Therefore, in the unbalanced-feed wideband slot antenna apparatus according to the preferred embodiment of the present invention, when the lengths Wg1 and Wg2 of the side portions 105*a*1 and 105*a*2 are configured to be larger than or equal to the length Lsw equivalent to one-quarter effective wavelength, the resonant frequency fd in the grounding conductor dipole antenna mode is always lower than the resonant frequency fs of the slot 111, and thus a wideband operation is ensured. In this case, the frequency fd is a lower limit frequency fL of the operating band of the unbalanced-feed wideband slot antenna apparatus (e.g., 3.1 GHz, as described above). From the point of view of size reduction, it is not practical to set the lengths Wg1 and Wg2 of the side portions 105*a*1 and 105*a*2 to be extremely large so that the frequency fd is considerably lower than the frequency fs. In other words, by setting either of the lengths Wg1 and Wg2 of the side portions 105*a*1 and 105*a*2 to a minimum value required which is greater than or equal to the length Lsw, it is possible in an embodiment of a small antenna, to bring the resonant frequency fd in the grounding conductor dipole antenna mode, close to the operating band in the slot antenna mode.

Unbalanced Feed Line 113 Including Loop Wiring Line 123

Next, a loop-shaped wiring line will be described in detail that dramatically extends the operating band in the slot antenna mode and thus contributes to achieving a wideband operation in the unbalanced-feed wideband slot antenna apparatus according to the preferred embodiment of the present invention.

The unbalanced feed line 113 is branched at a first position near the slot 111 into a group of branch lines including at least two branch lines, and at least two branch lines among the group of branch lines are connected to each other at a second position near the slot 111 and different from the first position, thus configuring at least one loop wiring line on the unbalanced feed line 113.

As shown in FIG. 1, in the unbalanced-feed wideband slot antenna apparatus according to the preferred embodiment of the present invention, at least a partial region of the unbalanced feed line 113 is replaced by a loop wiring line 123, near a location where the unbalanced feed line 113 intersects with the slot 111. Therefore, the loop wiring line 123 intersects with at least one of a +Y-side boundary 237 and a −Y-side boundary 239 extending along a longitudinal direction of the slot 111 (i.e., an X-axis direction) and being defined between the slot 111 and the grounding conductor 103. The loop length Llo of the loop wiring line 123 is set to less than the effective wavelength at an upper limit frequency fH (e.g., 10.6 GHz, as described above) of the operating band of the unbalanced-feed wideband slot antenna apparatus. That is, a resonant frequency flo of the loop wiring line 123 is set to higher than the frequency fH. The configuration of the unbalanced feed line 113 is not limited to one including the loop wiring line 123, and the unbalanced feed line 113 may be configured such that a part of the unbalanced feed line 113 is branched off to form an open stub. In this case, the stub length of the open stub is set to less than a length equivalent to one-quarter effective wavelength at the upper limit frequency fH of the operating band. That is, a resonant frequency fst of the open stub is set to higher than the frequency fH. A dramatic improvement in the band characteristics of the unbalanced-feed wideband slot antenna apparatus according to the preferred embodiment of the present invention is not a resonance phenomenon of only the branched wiring lines itself, e.g., a phenomenon resulting from a resonance of the open stub in one-quarter effective wavelength. Such improvement is an effect appearing only when the slot 111 and the loop wiring line 123 are electromagnetically coupled to each other, thus increasing a number of the point of excitation in the slot resonator to include multiple points of excitation, and achieving an electrical length adjustment of an input impedance matching circuit.

Figure 5:
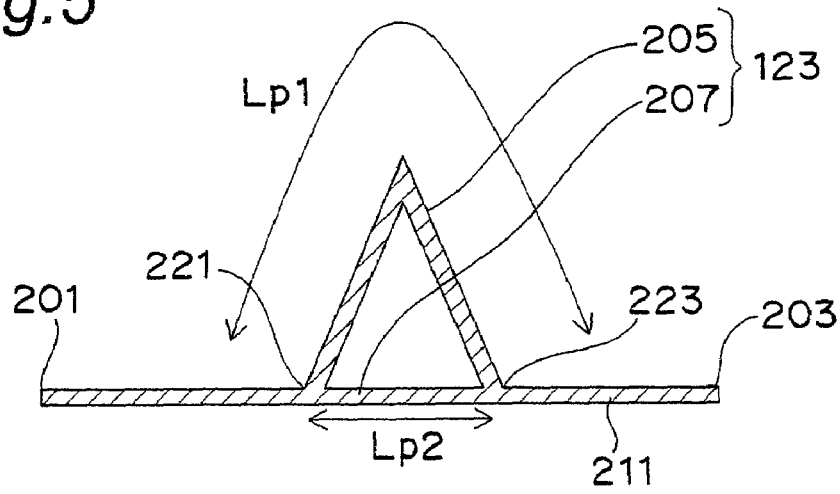
FIG. 5 is a schematic view of two circuits including branches in which a signal wiring line is branched as a loop wiring line, in a typical radio frequency circuit structure with an infinite grounding conductor structure on a backside thereof.

Now, with reference to FIG. 5, a phenomenon will be described that occurs when a loop wiring line structure is used in a typical radio frequency circuit which is assumed to have a grounding conductor with an infinite area on a backside thereof. FIG. 5 is a schematic circuit view in which a loop wiring line 123, including a first path 205 with a path length Lp1 and a second path 207 with a path length Lp2, is connected between an input terminal 201 and an output terminal 203. The loop wiring line is in a resonance state on condition that the sum of the path lengths Lp1 and Lp2 is identical to the effective wavelength of a transmission signal. In some cases satisfying such condition, the loop wiring line 123 has been used as a ring resonator. However, when the sum of the path lengths Lp1 and Lp2 is shorter than the effective wavelength of a transmission signal, a steep frequency response is not obtained, and thus there is no particular necessity to use the loop wiring line 123 in a typical radio frequency circuit. This is because an influence of local variations in current distribution is averaged, as macro-scale radio frequency characteristics in a radio frequency circuit having a grounding conductor with an infinite area.

On the other hand, by incorporating the loop wiring line 123 into the unbalanced-feed wideband slot antenna apparatus according to the preferred embodiment of the present invention as shown in FIG. 1, a unique effect is achieved that cannot be obtained by the aforementioned typical radio frequency circuit. The loop wiring line 123 intersects with the boundaries 237 and 239 between the slot 111 and the grounding conductor 103, and the slot 111 is excited at two or more points at which the boundaries 237 and 239 intersect with the loop wiring line 123 and which are apart form the open end 107 of the slot 111 by different distances. Specifically, a radio frequency current on the grounding conductor 103 is forced to flow in a direction 131*c* along the first path 205 of the loop wiring line 123, and to flow in a direction 131*d* along the second path 207 of the loop wiring line 123. As a result, different paths including 131*c* and 131*d* can be made as the flows of the radio frequency current on the grounding conductor 103, and accordingly, the slot 111 can be excited at multiple positions. By locally changing a radio frequency current distribution near the slot 111 in the grounding conductor 103, the resonance characteristics in the slot antenna mode are changed, thus dramatically extending the antenna operating band in the slot antenna mode.

Figure 8:
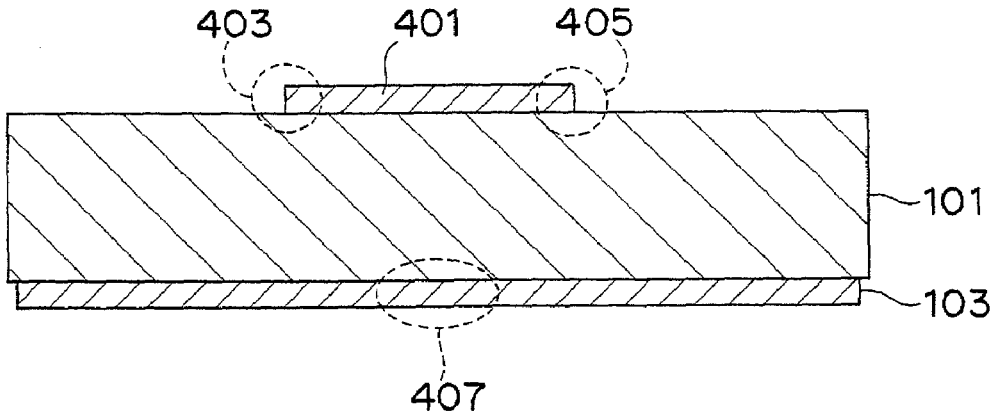
FIG. 8 is a cross-sectional view of a grounding conductor structure in which a typical transmission line is provided, for indicating portions where radio frequency currents concentrate.
Figure 9:
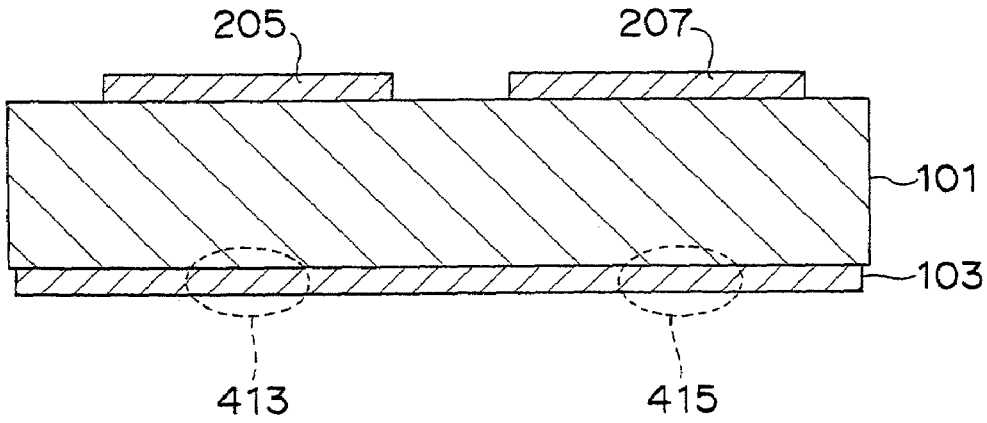
FIG. 9 is a cross-sectional view of a grounding conductor structure in which branched transmission lines are provided, for indicating portions where radio frequency currents concentrate.

FIGS. 8 and 9 schematically show cross-sectional views of transmission line structures for description. In a typical transmission line such as that shown in FIG. 8, a radio frequency current distribution is concentrated at edges 403 and 405 of a wiring line on the side of a strip conductor (i.e., a feed line) 401, and in a region 407 opposing to the strip conductor 401, on the side of a grounding conductor 103. Thus, it is difficult to cause large variations in a radio frequency current distribution on the side of the grounding conductor 103, by only increasing the width of the strip conductor of the unbalanced feed line 113 near the slot 111. As shown in FIG. 9, by branching a strip conductor into two paths 205 and 207, an efficient radio frequency current distribution can be achieved in different grounding conductor regions 413, 415 each opposed to the path 205, 207.

The loop wiring line 123 newly introduced into the unbalanced-feed wideband slot antenna apparatus according to the preferred embodiment of the present invention can not only have the aforementioned feature, but also have a feature of adjusting the electrical length of the unbalanced feed line 113. Due to variations in the electrical length of the unbalanced feed line 113, the resonance state of the unbalanced feed line 113 is changed to include multiple resonances, thus further enhancing the effect of extending the operating band according to the preferred embodiment of the present invention. That is, due to the introduction of the loop wiring line 123 near the slot 111, the impedance matching condition of the unbalanced feed line 113 coupled to the slot resonator is optimized in multiple cases each corresponding to a different frequency, thus achieving the extension of the operating band.

As descried above, since the first feature of providing the resonance phenomenon of the slot 111 itself with multiple resonances is combined to the second feature of providing the resonance phenomenon of the feed line 113 coupled to the slot 111 with multiple resonances, the unbalanced-feed wideband slot antenna apparatus according to the preferred embodiment of the present invention can operate in a wider band than that of prior art slot antenna apparatuses.

Constraint for Avoiding Influence of Undesired Resonance of Loop Wiring Line 123

Note that as a constraint for the loop wiring line 123 in order to maintain wideband impedance matching characteristics, it becomes necessary to use the loop wiring line 123 on a condition not causing a resonation of the loop wiring line 123 itself. For example, referring to the loop wiring line 123 shown in FIG. 5, a loop length Lp which is the sum of the path lengths Lp1 and Lp2 is set to less than the effective wavelength at the upper limit frequency fH of the operating band. When there are a plurality of loop wiring lines in the structure, the largest loop wiring line of such loop wiring lines that do not include any further small loop therein must satisfy the above-described condition.

Figure 6:
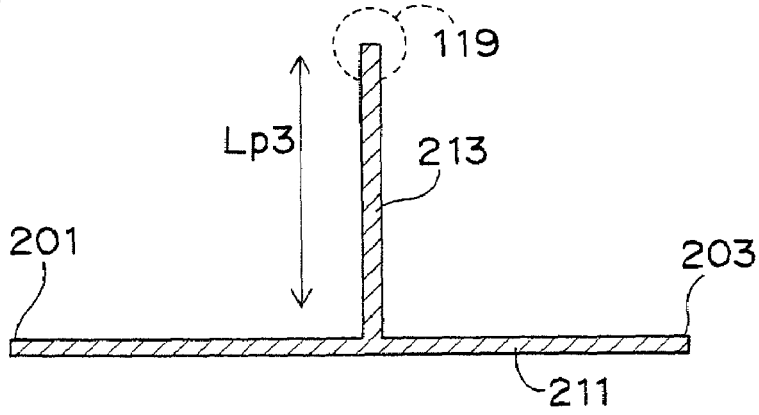
FIG. 6 is a schematic view of two circuits including branches in which a signal wiring line branches off an open-ended stub wiring line, in a typical radio frequency circuit structure with an infinite grounding conductor structure on a backside thereof.
Figure 7:
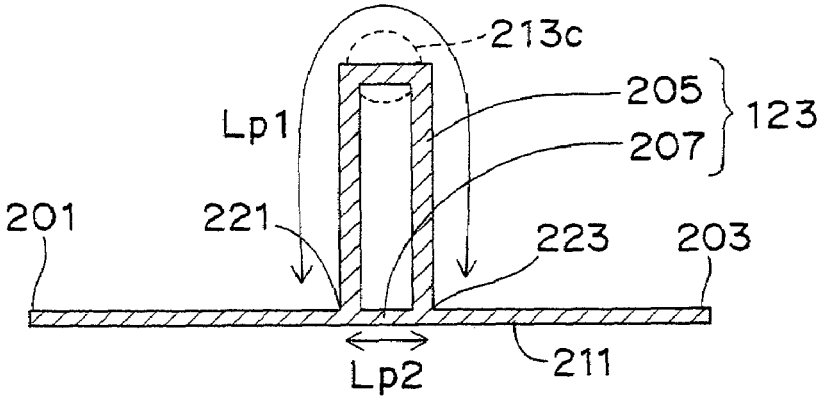
FIG. 7 is a schematic view of two circuits including branches in which a signal wiring line is branched as a loop wiring line, and particularly, in which a second path is configured to be extremely short, in a typical radio frequency circuit structure with an infinite grounding conductor structure on a backside thereof.

On the other hand, as a more common radio frequency circuit than a loop wiring line, an open stub shown in FIG. 6 is provided. Some of wiring lines into which the unbalanced feed line 113 of the unbalanced-feed wideband slot antenna apparatus according to the preferred embodiment of the present invention is branched may adopt the structure of an open stub 213. However, for the object of the present invention, the use of a loop wiring line is more advantageous than the use of an open stub in terms of wideband characteristics. Since the open stub 213 is a one-quarter effective wavelength resonator, a stub length Lp is, even in the longest case, set to less than a length equivalent to one-quarter effective wavelength at the frequency fH. FIG. 7 shows an extreme example of the loop wiring line 123, illustrating an advantageous feature of the loop wiring line 123 over the open stub 213. When reducing the length Lp2 of one path in the loop wiring line 123 to be extremely short, an appearance of the loop wiring line 123 approximates to that of the open stub 213 as closely as desired. However, the resonant frequency of the loop wiring line 123 for the case with the path length Lp2 close to 0 is a frequency at which the effective wavelength is equivalent to the other path length Lp1, and on the other hand, the resonant frequency of the open stub 213 is a frequency at which one-quarter of the effective wavelength is equivalent to a path length Lp3 of the open stub 213. Comparing these two structures under an assumption that a half of the path length Lp1 of the loop wiring line 123 is equal to the path length Lp3 of the open stub 213, the lowest-order resonant frequency of the loop wiring line 123 is equivalent to twice the lowest-order resonant frequency of the open stub 213. According to the above description, as a feed line structure for avoiding an undesired resonance phenomenon in a wide operating band, the loop wiring line 123 is twice as effective in terms of a frequency band as the open stub 213. Further, since the circuit is opened at an open termination point 119 of the open stub 213 in FIG. 6, no radio frequency current flows at that point, and thus, even if the open termination point 119 is provided near the slot 111, it is difficult to electromagnetically couple it to the slot 111. On the other hand, as shown in FIG. 7, the circuit is never opened at a point 213*c* of the loop wiring line 123, and a radio frequency current always flows at that point, and thus, if the loop wiring line 123 is provided near the slot 111, it is easy to electromagnetically couple it to the slot 111. Also from this point of view, it is advantageous to adopt a loop wiring line than an open stub for the object of the present invention.

According to the above description, it is shown that in order to extend the bandwidth of the unbalanced-feed wideband slot antenna apparatus according to the preferred embodiment of the present invention, it is most effective to introduce a loop wiring line, rather than adopting a line with thick line width, or an open stub.

Note that even when the grounding conductor of the first prior art example is limited to a finite area, it is considerably difficult to ensure continuity with a band in the grounding conductor dipole antenna mode, unless a feature is provided for extending the operating band in the slot antenna mode to the lower frequency side. Furthermore, a wideband operation cannot be implemented either, unless a feature is provided for extending the operating band in the slot antenna mode to the higher frequency side, as in the preferred embodiment of the present invention.

Inductive Region 121 Introduced into Unbalanced Feed Line 113

As shown in FIG. 1, it is desirable that a portion of the unbalanced feed line 113, corresponding to a region extending over a certain length Lind from an open-ended point 119 of the unbalanced feed line 113, is configured as an inductive region 121 formed of a wiring line with a higher characteristic impedance than a characteristic impedance (i.e., 50 ohms) of the unbalanced feed line 113. The length Lind has a value equivalent to the extent of one-quarter effective wavelength at the resonant frequency fs of the slot 111 (i.e., as described above, the frequency equal to the center frequency fc of the operating band of the unbalanced-feed wideband slot antenna apparatus). It is desirable that the loop wiring line 123 is formed within the inductive region 121. It is desirable that the inductive region 121 intersects with the slot 111 at substantially the center of the longitudinal direction (i.e., the Y-axis direction) of the inductive region 121. The inductive region 121 forms a one-quarter effective wavelength resonator, and is coupled to the one-quarter effective wavelength resonator formed by the slot 111, thus further helping to include multiple resonance, and as a result, the antenna operating band of the slot 111 in the slot antenna mode is effectively increased. Additionally, as a synergistic effect by further introducing the structure of the loop wiring line 123 according to the preferred embodiment of the present invention, it is possible to achieve a low-reflection operation in a wideband. It is desirable that the line width of the loop wiring line 123 is configured to be equal to or thinner than the line width of the unbalanced feed line 113 in the inductive region 121.

Stop Band Setting by Parasitic Slot Resonators 108*c* and 108*d*

Now, the one-end-open parasitic slot resonators 108*c* and 108*d* will be described which are additionally introduced into the grounding conductor 103 to set a certain stop band.

According to the preferred embodiment of the present invention with the configuration described above, the unbalanced-feed wideband slot antenna apparatus is implemented in which the main beam direction is always maintained in forward (i.e., the −X direction) across the operating band, and low-reflection characteristics are achieved in a wideband. Next, a configuration in the grounding conductor 103 will be described, for forming in the operating band a stop band where an antenna operation is suppressed. As shown in FIG. 1, in the unbalanced-feed wideband slot antenna apparatus according to the preferred embodiment of the present invention, at least one of the one-end-open parasitic slot resonators 108*c* and 108*d* is formed in the grounding conductor 103. In the example of FIG. 1, the parasitic slot resonator 108*c* is configured such that the open end 110*c* thereof is positioned at the side 105*c*, and the parasitic slot resonator 108*d* is configured such that the open end 110*d* thereof is positioned at the side 105*d*. The effects according to the preferred embodiment of the present invention can appear even when the open ends of the respective parasitic slot resonators are provided at any of the sides 105*a*1 and 105*a*2 on the −X side, the side 105*b* on the +X side, the side 105*c* on the +Y side, and the side 105*d* on the −Y side of the grounding conductor 103. However, note that in order not to interfere with the operation in the dipole antenna mode, it is desirable that the open ends of the respective parasitic slot resonators are provided at positions other than the sides 105*a*1 and 105*a*2 on the −X side. Note also that the added parasitic slot resonators 108*c* and 108*d* must be formed at locations of the grounding conductor 103 where they do not intersect with the unbalanced feed line 113. In other words, only the slot 111 contributing to radiation should be coupled to the unbalanced feed line 113, and the parasitic slot resonators 108*c* and 108*d* should not be electromagnetically coupled to the unbalanced feed line 113. Each slot length of the parasitic slot resonators 108*c* and 108*d* is set to one-quarter effective wavelength in a band to be stopped. By implementing a symmetric configuration in the parasitic slot resonators 108*c* and 108*d* so as to have an equal distance from the open end 107 of the slot 111, to have an equal slot width, and to have an equal slot length, an effect of maintaining the main beam direction in just forward across the operating band is obtained. In addition, a band-stop feature can appear even when only one of the parasitic slot resonators 108*c* and 108*d* is provided. It is also possible to extend the stop band by changing the slot lengths of the parasitic slot resonators 108*c* and 108*d* so as to be slightly different from each other, for adjusting each resonant frequency.

Modified Preferred Embodiments of the First Preferred Embodiment

Figure 3:
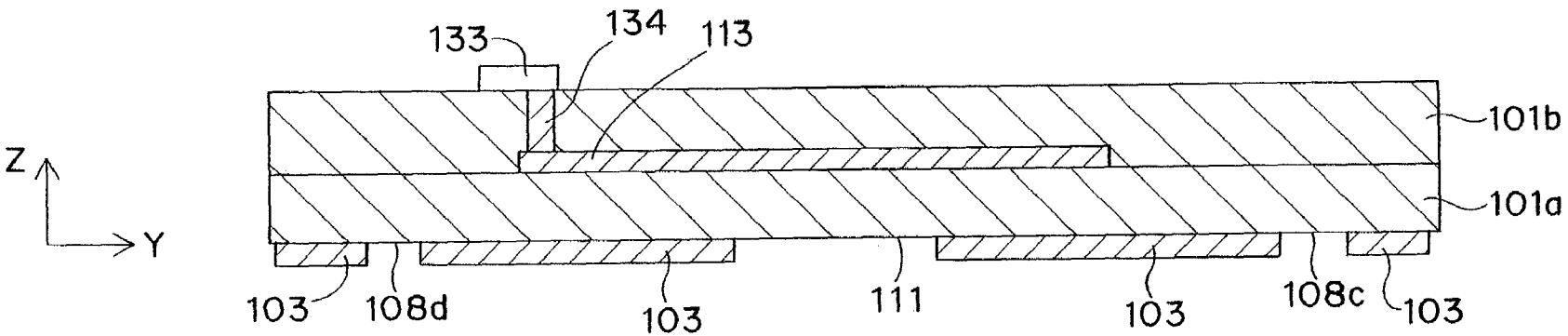
FIG. 3 is a schematic cross-sectional view showing a structure of an unbalanced-feed wideband slot antenna apparatus according to a first modified preferred embodiment of the first preferred embodiment of the present invention.
Figure 4:
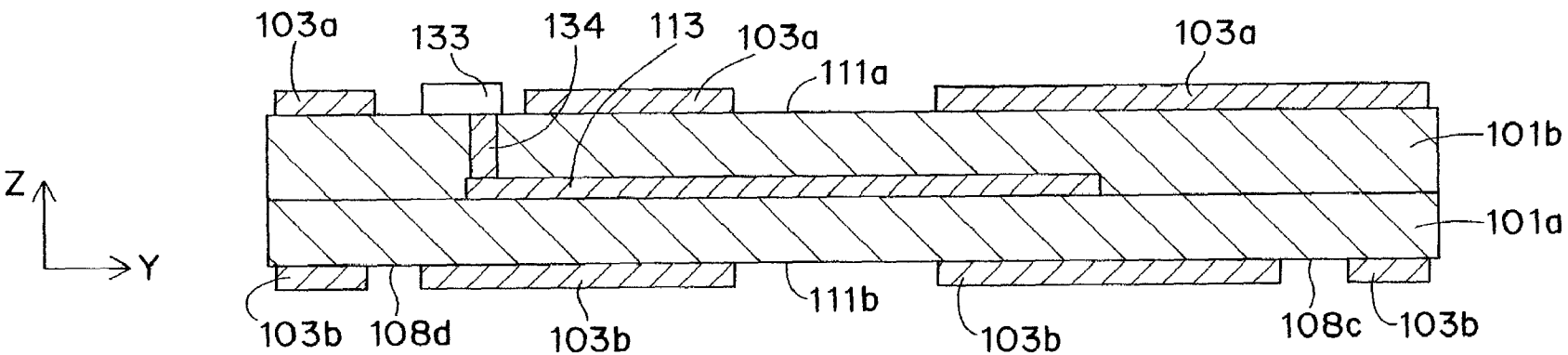
FIG. 4 is a schematic cross-sectional view showing a structure of an unbalanced-feed wideband slot antenna apparatus according to a second modified preferred embodiment of the first preferred embodiment of the present invention.

FIG. 3 is a schematic cross-sectional view showing a structure of an unbalanced-feed wideband slot antenna apparatus according to a first modified preferred embodiment of the first preferred embodiment of the present invention. FIG. 4 is a schematic cross-sectional view showing a structure of an unbalanced-feed wideband slot antenna apparatus according to a second modified preferred embodiment of the first preferred embodiment of the present invention.

Although in this specification, the structure as shown in FIG. 2 is mainly described in which the feed line 113 is provided on the front-side of the dielectric substrate 101 (i.e., an uppermost surface) and the grounding conductor 103 is provided on the backside of the dielectric substrate 101 (i.e., a lowermost surface), different structures as shown in FIGS. 3 and 4 may be adopted instead of the structure in FIG. 2.

The unbalanced-feed wideband slot antenna apparatus shown in FIG. 3 is configured with a multilayer substrate including a plurality of dielectric layers 101*a* and 101*b*, instead of the dielectric substrate 101 in FIG. 2, and an unbalanced feed line 113 (and an inductive region 121 in the unbalanced feed line 113) is formed at an inner layer between the dielectric layers 101*a* and 101*b*. As such, by means of methods such as adopting a multilayer substrate, one or both of the feed line 113 and a grounding conductor 103 may be arranged on an inner-layer surface of the dielectric substrate 101.

In the unbalanced-feed wideband slot antenna apparatus shown in FIG. 4, grounding conductors 103*a* and 103*b* are formed on both the front-side and backside of a substrate, instead that the grounding conductor 103 is provided only on the backside of the substrate as shown in FIG. 3. Slots to be fed are formed on both the front-side and backside of the substrate (slots 111*a* and 111*b*), and parasitic slot resonators are formed only on the backside of the substrate (parasitic slot resonators 108*c* and 108*d*). As such, a number of conductor surfaces for wiring lines operating as the grounding conductor 103 opposed to the feed line 113 does not need to be limited to one in a structure, and a structure may be adopted in which the grounding conductors 103*a* and 103*b* are arranged such that they are opposed to each other and such that a layer with the unbalanced feed line 113 formed thereon is between them. In other words, in the unbalanced-feed wideband slot antenna apparatus according to the preferred embodiment of the present invention, it is possible to obtain the same effect not only with the circuitry adopting a microstrip line structure, but also with the circuitry adopting a strip line structure in at least part of the apparatus. The same also applies in the case that each of the coplanar line and ground coplanar line structures is adopted.

In the embodiments of the layered structures as shown in FIGS. 3 and 4, a circuit block 133 may be connected to the unbalanced feed line 113 by means of a through-hall electrode 134 penetrating through the layers.

Figure 10:
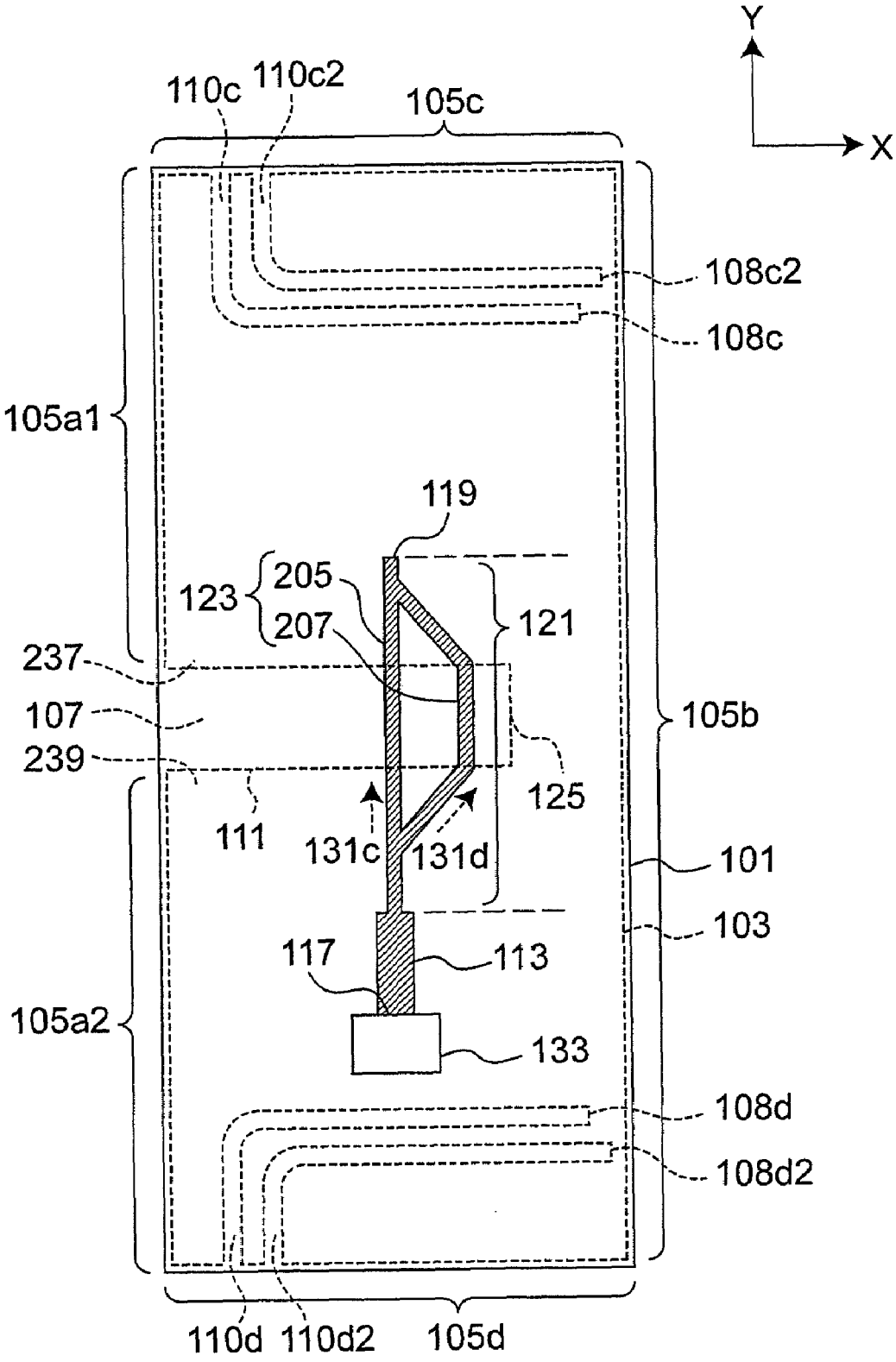
FIG. 10 is a schematic top view showing a structure of an unbalanced-feed wideband slot antenna apparatus according to a third modified preferred embodiment of the first preferred embodiment of the present invention.

FIG. 10 is a schematic top view showing a structure of an unbalanced-feed wideband slot antenna apparatus according to a third modified preferred embodiment of the first preferred embodiment of the present invention. The unbalanced-feed wideband slot antenna apparatus according to the preferred embodiment of the present invention is provided with not only a pair of parasitic slot resonators 108*c* and 108*d* as shown in FIG. 1, but also may be additionally provided with further one-end-open parasitic slot resonators 108*c*2 and 108*d*2. It is possible to extend the stop band by adjusting the resonant frequencies of the parasitic slot resonator 108*c* and the parasitic slot resonator 108*c*2, and the parasitic slot resonator 108*d* and the parasitic slot resonator 108*d*2. In order to reduce the areas occupied by the parasitic slot resonators 108*c* and 108*d*, it is effective to provide additional slots in parallel manner, adopt a meander shape, and adopt a number of bent structures.

Figure 11:
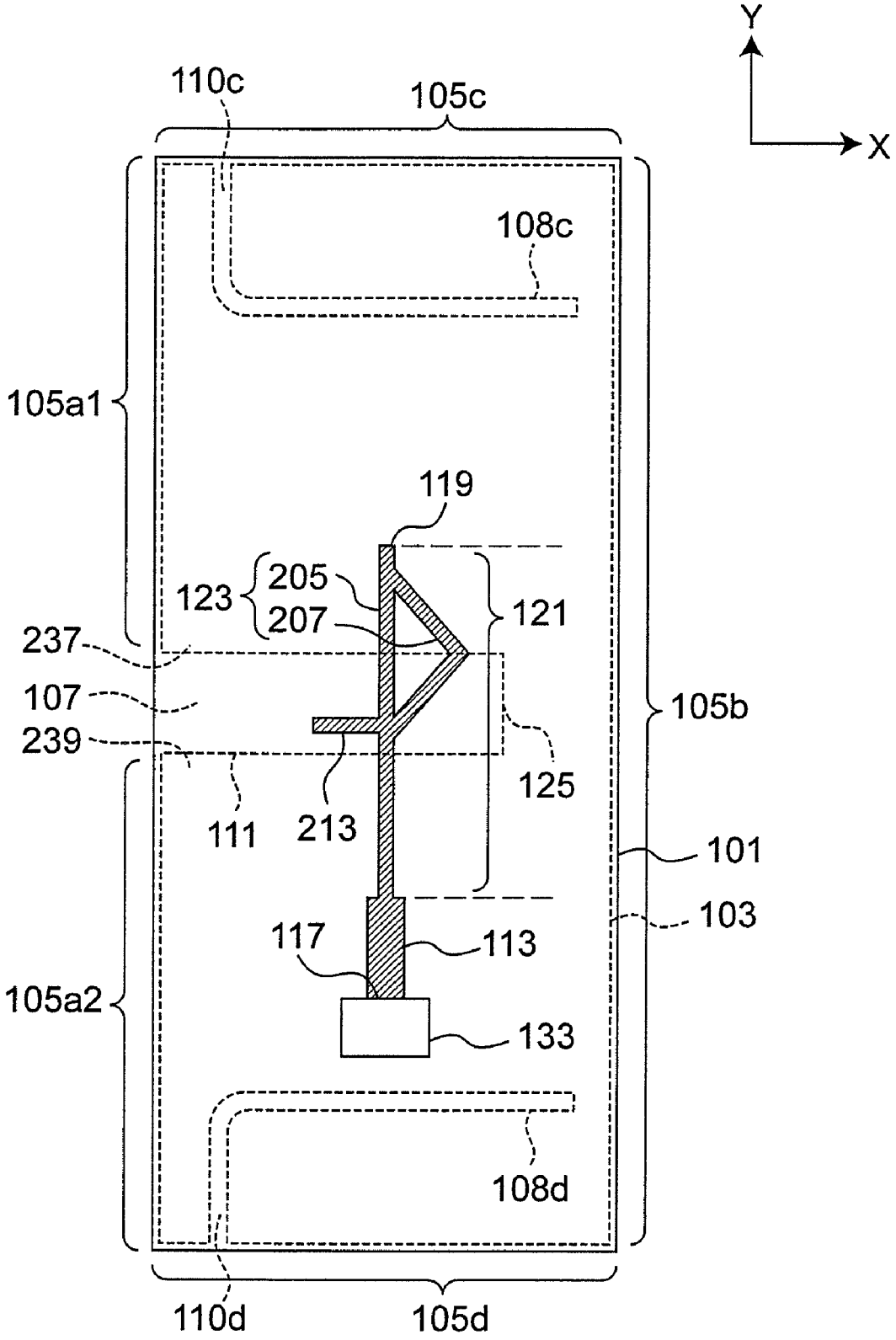
FIG. 11 is a schematic top view showing a structure of an unbalanced-feed wideband slot antenna apparatus according to a fourth modified preferred embodiment of the first preferred embodiment of the present invention.

FIG. 11 is a schematic top view showing a structure of an unbalanced-feed wideband slot antenna apparatus according to a fourth modified preferred embodiment of the first preferred embodiment of the present invention. As shown in FIG. 11, some of wiring lines into which an unbalanced feed line 113 of the unbalanced-feed wideband slot antenna apparatus according to the preferred embodiment of the present invention is branched may adopt the open stub structure 213 as described above.

Figure 12:
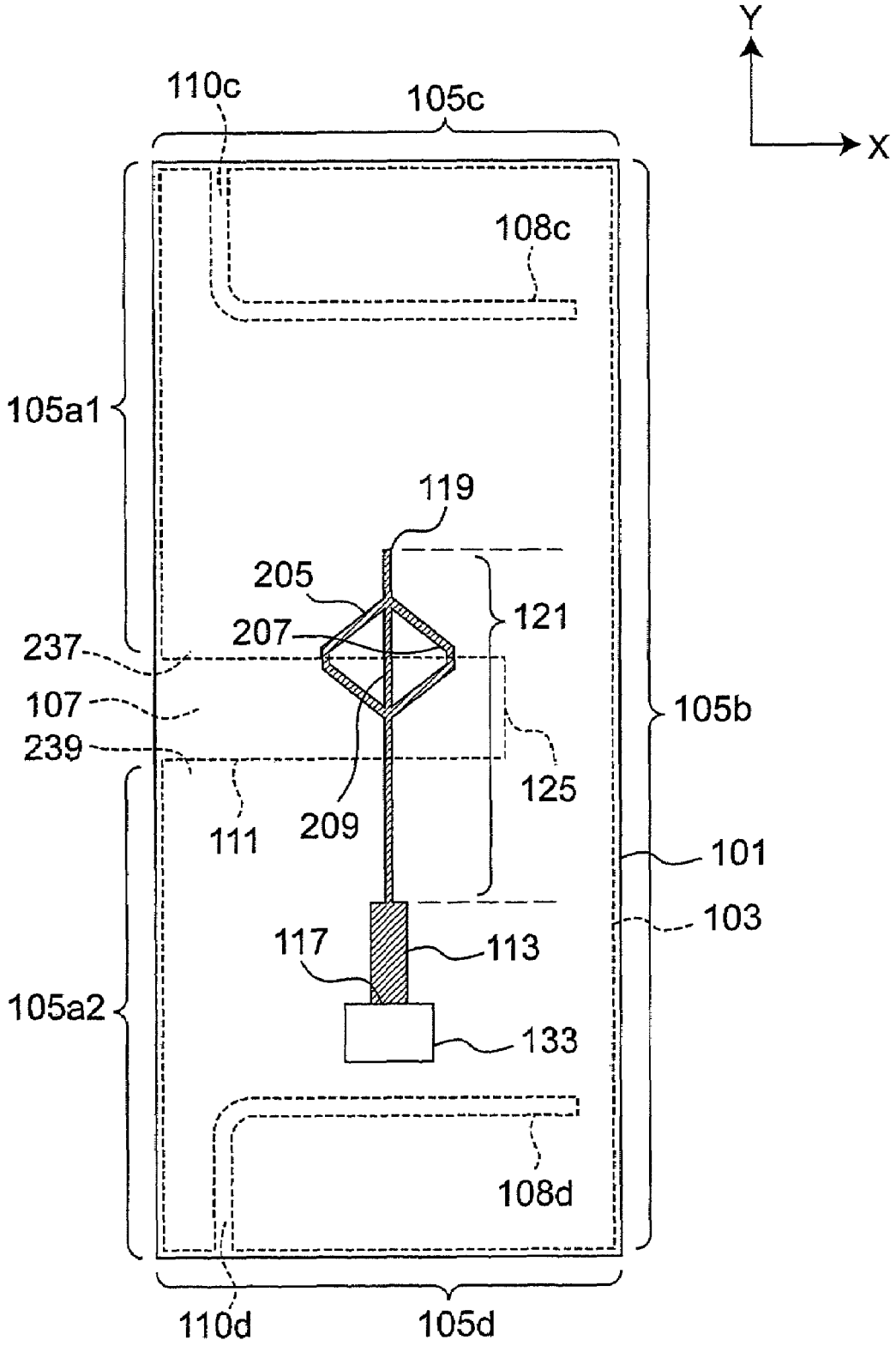
FIG. 12 is a schematic top view showing a structure of an unbalanced-feed wideband slot antenna apparatus according to a fifth modified preferred embodiment of the first preferred embodiment of the present invention.

FIG. 12 is a schematic top view showing a structure of an unbalanced-feed wideband slot antenna apparatus according to a fifth modified preferred embodiment of the first preferred embodiment of the present invention.

The modified preferred embodiment in FIG. 12 shows the case in which a branch line portion of an unbalanced feed line 113 includes three branches. By inserting a path 209 into middle of paths 205 and 207, a loop wiring line including the paths 205 and 209 and a loop wiring line including the paths 207 and 209 are formed, instead of an original loop wiring line including the paths 205 and 207. A maximum value of the respective loop lengths of these loop wiring lines is set to a length less than one effective wavelength at an upper limit frequency of the operating band of the unbalanced-feed wideband slot antenna apparatus. According to the configuration of the present modified preferred embodiment, since the path lengths of the loop wiring lines are reduced as compared to the case of FIG. 1, thus increasing the resonant frequencies of the loop wiring lines, it is effective in terms of the extension of the operating band.

A plurality of loop wiring lines may be formed. The plurality of loop wiring lines may be connected to each other in series or in parallel. Two of the loop wiring lines may be directly connected to each other, or may be indirectly connected to each other through a transmission line of any shape.

Figure 13:
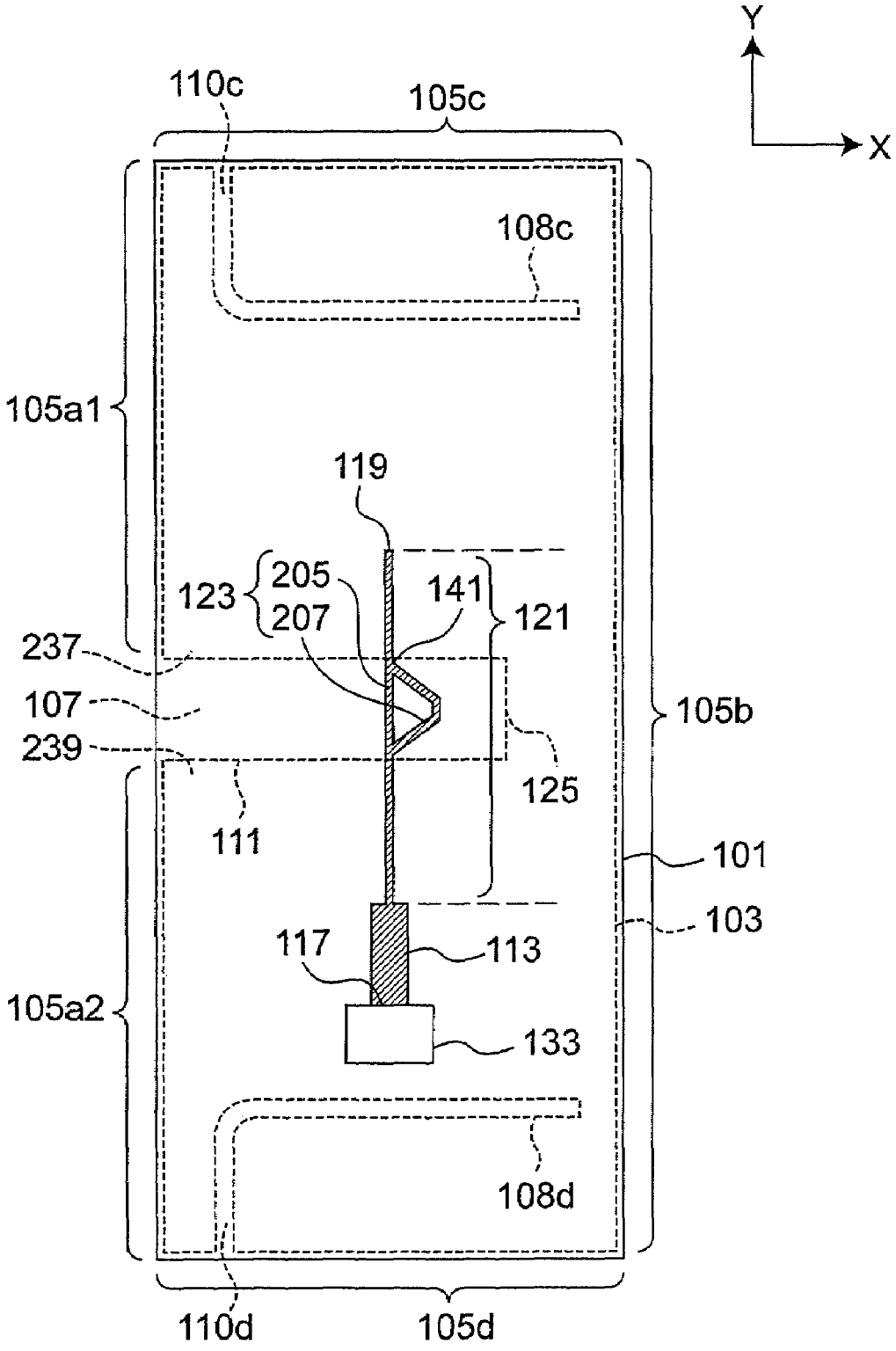
FIG. 13 is a schematic top view showing a structure of an unbalanced-feed wideband slot antenna apparatus according to a sixth modified preferred embodiment of the first preferred embodiment of the present invention.
Figure 14:
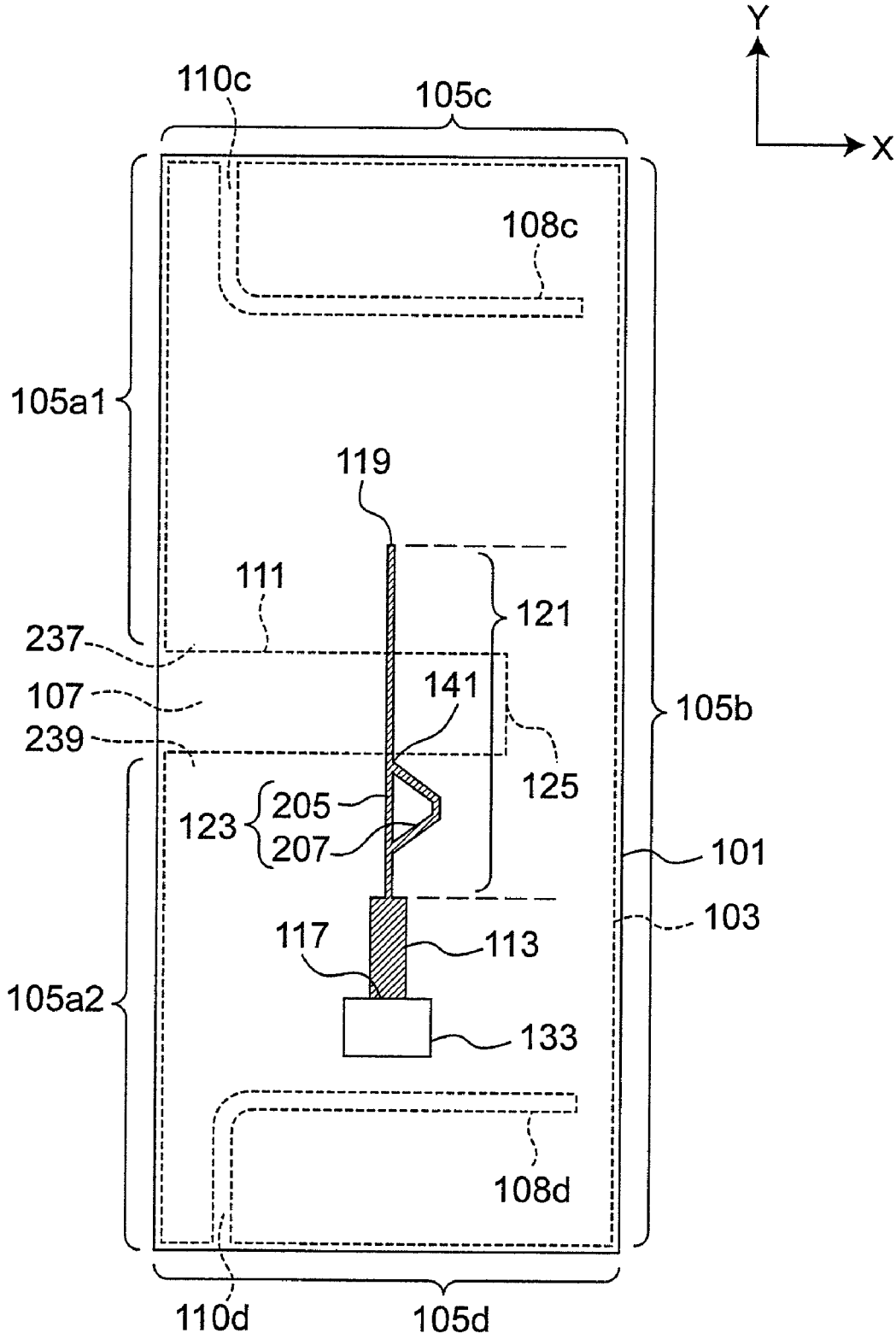
FIG. 14 is a schematic top view showing a structure of an unbalanced-feed wideband slot antenna apparatus according to a seventh modified preferred embodiment of the first preferred embodiment of the present invention.

FIG. 13 is a schematic top view showing a structure of an unbalanced-feed wideband slot antenna apparatus according to a sixth modified preferred embodiment of the first preferred embodiment of the present invention. FIG. 14 is a schematic top view showing a structure of an unbalanced-feed wideband slot antenna apparatus according to a seventh modified preferred embodiment of the first preferred embodiment of the present invention. With reference to FIGS. 13 and 14, a relationship between positions of the loop wiring line 123 and the slot 111 will be described.

Although in the example of FIG. 1, the loop wiring line 123 intersect with both of the +Y-side boundary 237 and the −Y-side boundary 239 extending along the longitudinal direction of the slot 111, it is possible to obtain the effects according to the preferred embodiment of the present invention even with a configuration in which the loop wiring line 123 does not intersect with either of the boundaries 237 and 239 between the slot 111 and the grounding conductor 103. This is because a phase difference in radio frequency currents exciting a slot 111 occurs which corresponds to a path difference between a first path 205 and a second path 207, thus producing an effect of extending an input impedance matching condition to a wider band. Strictly speaking, spacing between an outermost (i.e., the +Y side) point 141 of a loop wiring line 123 and a boundary 237 (or 239) should be less than the line width of an unbalanced feed line 113. This is because when the spacing is configured to be shorter than the line width of the unbalanced feed line 113, a phase difference does not disappear, which occurs between local radio frequency currents flowing through the side of a grounding conductor 103 corresponding to a phase difference between radio frequency currents flowing through both edges of the strip conductor. However, note that in order to maximize the effects according to the preferred embodiment of the present invention, it is desirable that the first path 205 and the second path 207 intersect with at least any one of the boundaries 237 and 239 between the slot 111 and the grounding conductor 103 as shown in FIG. 1.

Note that in the unbalanced-feed wideband slot antenna apparatus according to the preferred embodiment of the present invention, the shape of the slot 111 which is a feeding slot resonator does not need to be rectangular, and its shape can be replaced by any shape. Connecting an additional slot in parallel to a main slot is equivalent, as the circuitry, to adding a inductance in series to the main slot, and thus, it is desirable in practice because the effective slot length of the main slot can be reduced. Further, it is possible to obtain the effect of extending the band of the unbalanced-feed wideband slot antenna apparatus according to the preferred embodiment of the present invention as well, even under a condition in which the main slot is reduced in the slot width and bent into a shape such as a meander shape, for the purpose of the size reduction.

Second Preferred Embodiment

Figure 15:
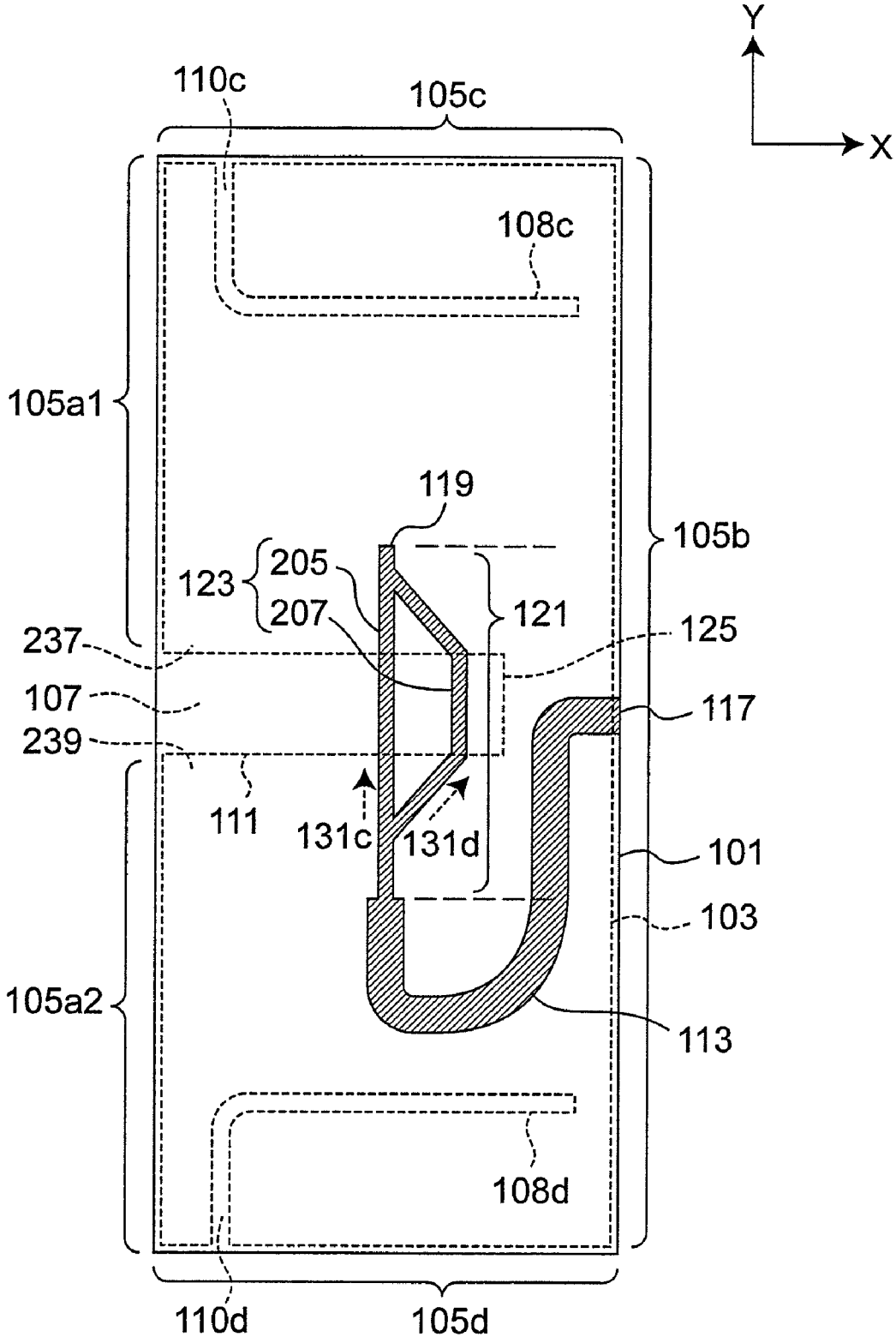
FIG. 15 is a schematic top view showing a structure of an unbalanced-feed wideband slot antenna apparatus according to a second preferred embodiment of the present invention.

FIG. 15 is a schematic top view showing a structure of an unbalanced-feed wideband slot antenna apparatus according to a second preferred embodiment of the present invention. The unbalanced-feed wideband slot antenna apparatus according to the present preferred embodiment is characterized by having a different feed structure than that in the first preferred embodiment. As shown in FIG. 15, a grounding conductor 103 is configured to be symmetric about a symmetry axis in an X-axis direction passing through a slot 111, and then, an unbalanced feed line 113 is connected to an antenna feeding point 117 provided on the symmetry axis of the grounding conductor 103 at the +X side of the grounding conductor 103. Thus, since the antenna feeding point 117 is provided on the symmetry axis of the grounding conductor 103, the antenna feeding point 117 has an input and output impedance higher than to an impedance in an unbalanced mode of the grounding conductor 103.

As shown in FIG. 15, the unbalanced feed line 113 of the unbalanced-feed wideband slot antenna apparatus according to the preferred embodiment of the present invention can also adopt a structure in which the unbalanced feed line 113 intersects with the slot 111, and then, is bent by at least 90 degrees or more in the wiring direction within a front-side of a dielectric substrate 101, and reaches the antenna feeding point 117 provided at a side (i.e., the +X side) of the dielectric substrate 101 opposite to a side at which an open end 107 of the slot 111 is provided. In other words, the present preferred embodiment is useful for a configuration for limiting circuit blocks integrated on an antenna substrate, and carrying RF signals between an antenna circuit area and an external circuit using an unbalanced line, unlike the configuration as shown in FIG. 1 in which the circuit block 133 is provided on the antenna substrate. The antenna feeding point 117 is provided near the center of the +X side of the dielectric substrate 101.

In a slot antenna mode appearing by exciting the slot 111 through the unbalanced feed line 113, radio frequency currents commonly appear at a short-circuited end 125 of the slot 111. The appeared radio frequency currents flow along boundaries between the slot 111 and the grounding conductor 103, and when reaching to an open end 107, the radio frequency currents flow along an outer edge of the grounding conductor 103. In this case, if another conductor is connected to the outer edge of the grounding conductor 103, since the impedance of the connected conductor is very low, it is difficult to prevent the radio frequency current from flowing through the connected conductor. It is not practical to reflect an unbalanced radio frequency current flowing through the connected conductor by means of a ferrite core, from the point of view of the insertion loss of the ferrite core. Moreover, It is not practical to firstly convert the feed circuit from an unbalanced circuit to a balanced circuit and then reconvert from the balanced circuit to the unbalanced circuit by using baluns, from the point of view of the insertion loss of ultra-wideband baluns, and the size reduction of the circuitry. However, by providing the antenna feeding point 117 at a position of a high symmetry as described above, it is possible to achieve an extremely high input and output impedance with respect to a radio frequency current flowing on the grounding conductor 103 in the unbalanced mode (this current has an impedance in the unbalanced mode), and thus to eliminate an influence from the conductor connected to the grounding conductor 103, without involving additional loss or narrowing the band.

Figure 16:
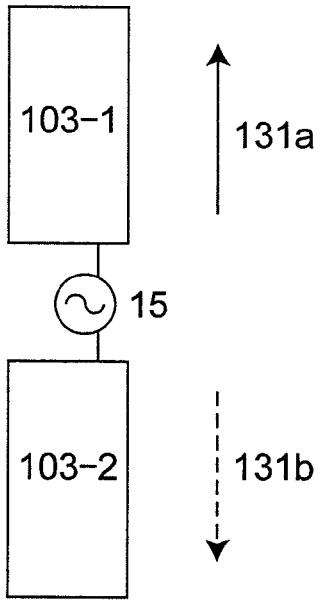
FIG. 16 is a schematic view showing how radio frequency currents flow in a grounding conductor 103 for the case of a balanced mode.
Figure 17:
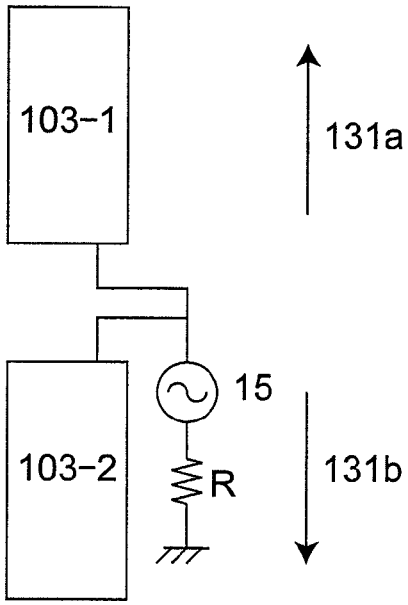
FIG. 17 is a schematic view showing how radio frequency currents flow in the grounding conductor 103 for the case of an unbalanced mode.

The grounding conductor 103 in the unbalanced-feed wideband slot antenna apparatus structure shown in FIG. 15 can be considered to be a conductor structure in which a pair of grounding conductors 103-1 and 103-2 with a high symmetry and a finite area are combined at the short-circuited end 125 of the slot 111. FIG. 16 is a schematic view showing how radio frequency currents flow in the grounding conductor 103 for the case of the balanced mode. FIG. 17 is a schematic view showing how radio frequency currents flow in the grounding conductor 103 for the case of the unbalanced mode. FIGS. 16 and 17 schematically show how radio frequency currents flow in the grounding conductor 103, as relationships to feed structures in the respective modes. In the balanced mode, equivalently, the pair of grounding conductors 103-1 and 103-2 are fed with radio frequency currents 131*a* and 131*b* with opposite phases, each flowing in a direction of arrow from a feeding point 15, and as a result, the largest radio frequency current with the same phase flows at a connecting point between the pair of grounding conductors, i.e., the short-circuited end 125 of the slot 111. On the other hand, in the unbalanced mode, equivalently, the pair of grounding conductors 103-1 and 103-2 are fed with radio frequency currents 131*a* and 131*b* with the same phase, each flowing in a direction of arrow from the feeding point 15 (which is considered to be grounded through a certain impedance R), and as a result, the radio frequency currents can be cancelled at the connecting point between the pair of grounding conductors, i.e., at the antenna feeding point 15. The more symmetrically the pair of grounding conductors 103-1 and 103-2 are configured, and the closer the antenna feeding point 15 is positioned to the symmetry point of the grounding conductors, the higher the input and output impedance of the grounding conductors in the unbalanced mode is. Thus, by adopting the antenna feed condition shown in FIG. 15, even when an external unbalanced feed circuit is connected to the grounding conductor 103, it is possible to avoid backflow of an unbalanced grounding conductor current from the external unbalanced feed circuit to the grounding conductor 103. The effects according to the preferred embodiment of the present invention are further increased by setting the respective lengths of the pair of grounding conductors 103-1 and 103-2 (in other words, the lengths equivalent to lengths Wg1 and Wg2 of side portions 105*a*1 and 105*a*2 in FIG. 15) to the same value with each other. In addition, the effects according to the preferred embodiment of the present invention are further increased by configuring one-end-open parasitic slot resonators 108*c* and 108*d*, which are introduced to form a stop band, in pair as shown in FIG. 15, and configuring resonant frequencies, and open ends 110*c* and 110*d* of the parasitic slot resonators 108*c* and 108*d* to be mirror-symmetric about the symmetry axis in the X-axis direction passing through the slot 111.

In the preferred embodiment of the present invention, a connection between the grounding conductor 103 and an external unbalanced feed circuit at the antenna feeding point 117 is not limited to be established on a backside of a dielectric substrate 101. Specifically, it is possible to lead a grounding conductor to a front-side of a dielectric substrate near a connecting point through a through-hall conductor, and then, to establish a connection on the front-side of the dielectric substrate 101 in a manner of a coplanar line structure. Also in such configuration, advantageous effects according to the preferred embodiment of the present invention do not disappear. In fact, such configuration enables both connections for a strip conductor and for a grounding conductor on the front-side of the dielectric substrate 101, and thus, it is possible to mount the unbalanced-feed wideband slot antenna apparatus according to the preferred embodiment of the present invention onto a surface of an external mounting substrate.

Implementation Examples

In order to clarify the effects according to the preferred embodiments of the present invention, the impedance characteristics and radiation characteristics of slot antenna apparatuses of implementation examples of the present invention and slot antenna apparatuses of comparative examples were analyzed by a commercially available electromagnetic analysis simulator. Table 1 shows circuit board setting parameters common among first, second, and third implementation examples of the present invention. Table 2 shows circuit board setting parameters common between first and second comparative examples.

TABLE 1

| | |
|---|---|
| Material of dielectric substrate 101 | FR4 |
| Thickness H of dielectric substrate 101 | 0.5 mm |
| Depth D of dielectric substrate 101 | 11.5 mm |
| Width W of dielectric substrate 101 | 32 mm |
| Thickness t of wiring | 0.04 mm |
| Slot length Ls | 8.8 mm |
| Slow width Ws | 2.5 mm |
| Lengths Wg1 and Wg2 of side portions 105a1 and 105a2 on the −X side | 13.8 mm |
| Width W1 of unbalanced feed line 113 | 0.95 mm |
| Width W2 of inductive region 121 | 0.4 mm |
| Width W3 of loop wiring line | 0.25 mm |
| Distance d2 of unbalanced feed line 113 from open end 107 | 5.8 mm |
| Length Lind of inductive region 121 | 9 mm |
| Distance doff between paths of loop wiring line 123 | 1.4 mm |
| Width Was of parasitic slot resonator | 0.5 mm |
| Distance Das from the −X side to open end of parasitic slot resonator | 3 mm |

TABLE 2

| | |
|---|---|
| Material of dielectric substrate 101 | FR4 |
| Thickness H of dielectric substrate 101 | 0.5 mm |
| Depth D of dielectric substrate 101 | 11.5 mm |
| Width W of dielectric substrate 101 | 32 mm |
| Thickness t of wiring | 0.04 mm |
| Slot length Ls | 8.8 mm |
| Slow width Ws | 2.5 mm |
| Lengths Wg1 and Wg2 of side portions 105a1 and 105a2 on the −X side | 13.8 mm |
| Width W1 of unbalanced feed line 113 | 0.95 mm |
| Distance d2 of unbalanced feed line 113 | 5.8 mm |

TABLE 2-continued

| | |
|---|---|
| from open end 107 | |
| Offset distance Lm from open-ended termination point 119 of unbalanced feed line 113 to slot 111 | 4.5 mm |

In all analyses, the conditions were set on the assumption that the apparatuses were fabricated using circuit boards of the same size. Conductor patterns were assumed to be copper wirings with a thickness of 40 microns, and were considered to be in an accuracy range in which the conductor patterns could be formed by wet etching process.

Figure 18:
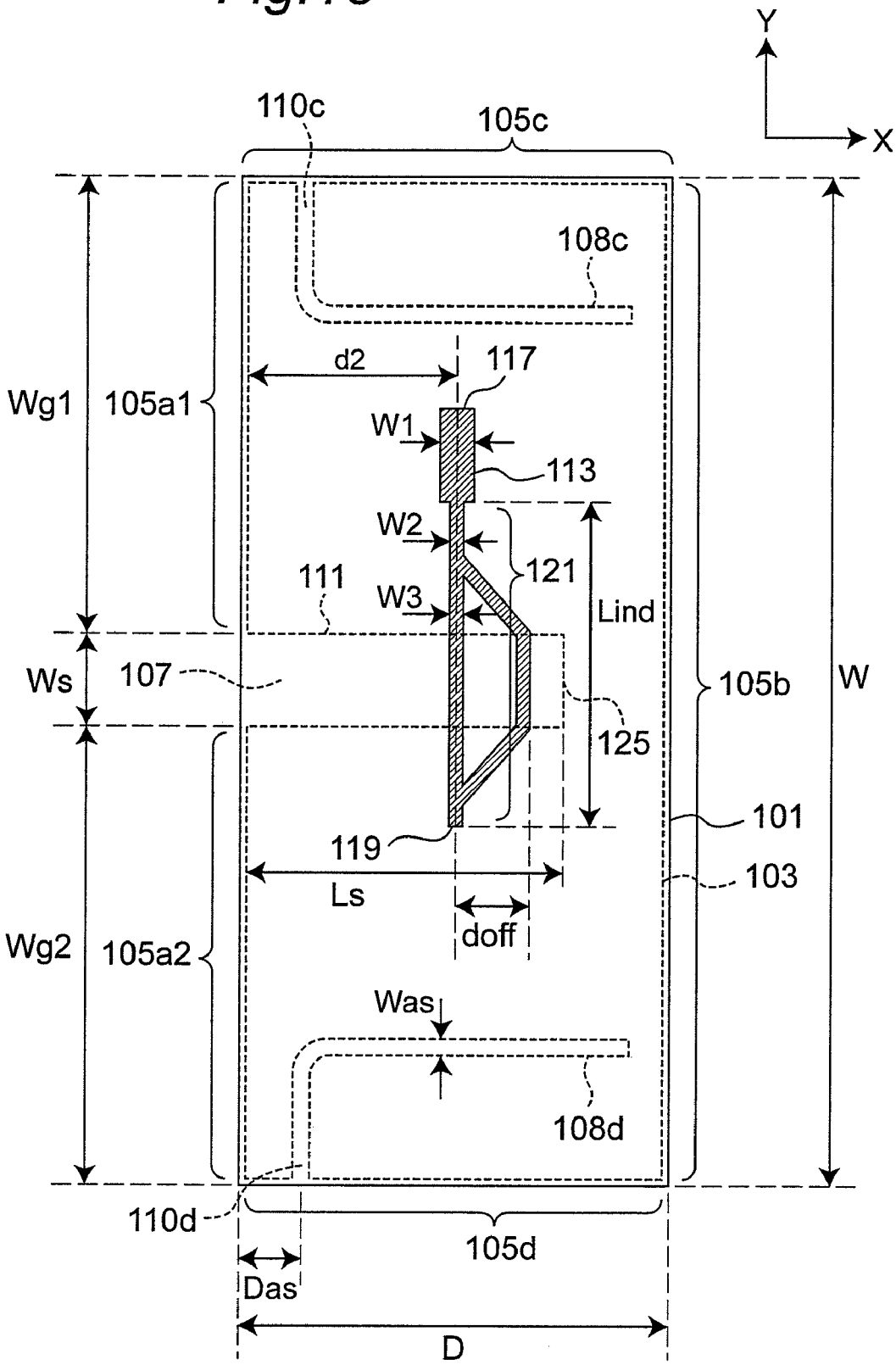
FIG. 18 is a schematic top view showing a structure of an unbalanced-feed wideband slot antenna apparatus according to a first implementation example of the present invention.
Figure 19:
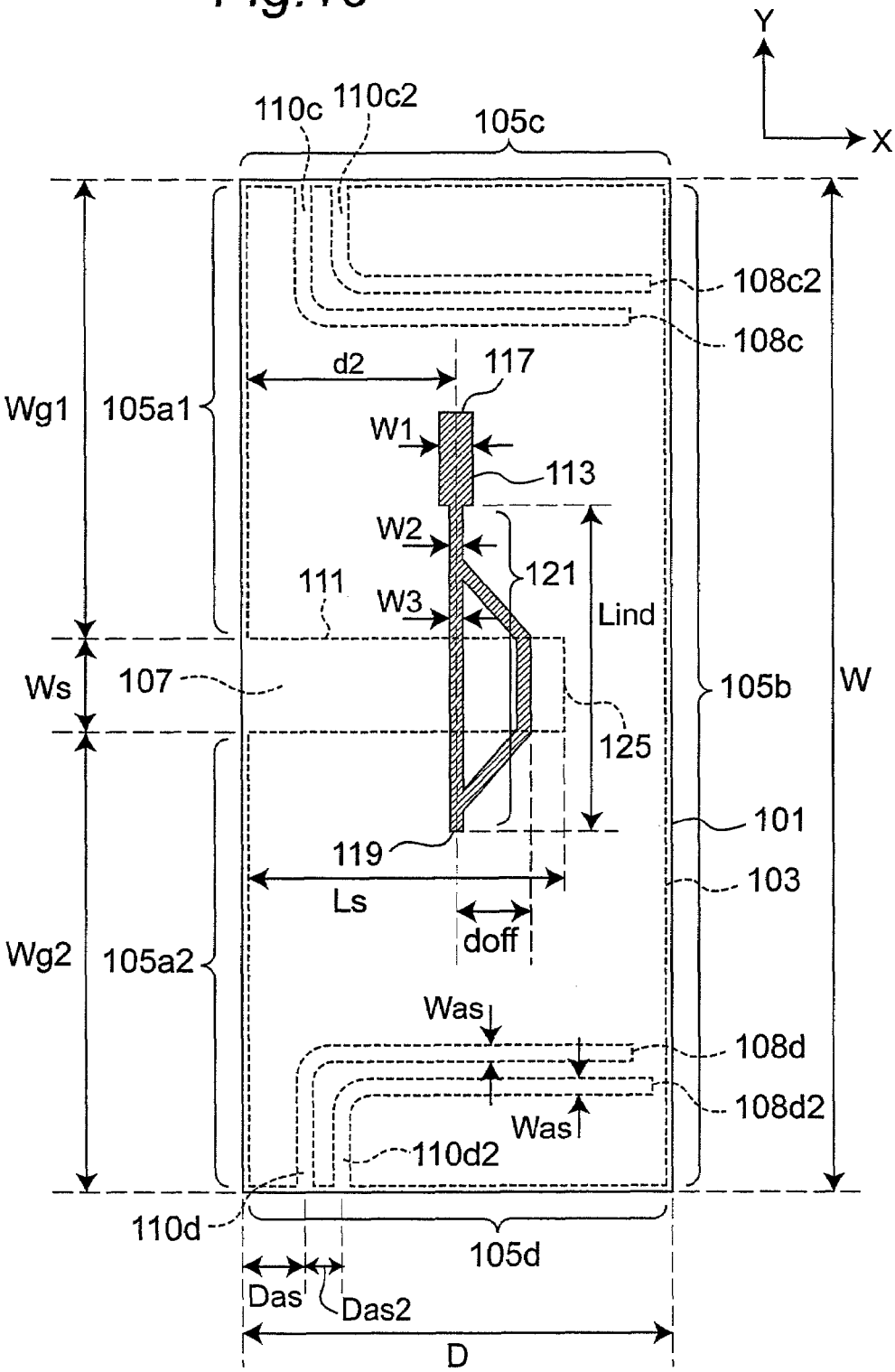
FIG. 19 is a schematic top view showing a structure of an unbalanced-feed wideband slot antenna apparatus according to a second implementation example of the present invention.
Figure 20:
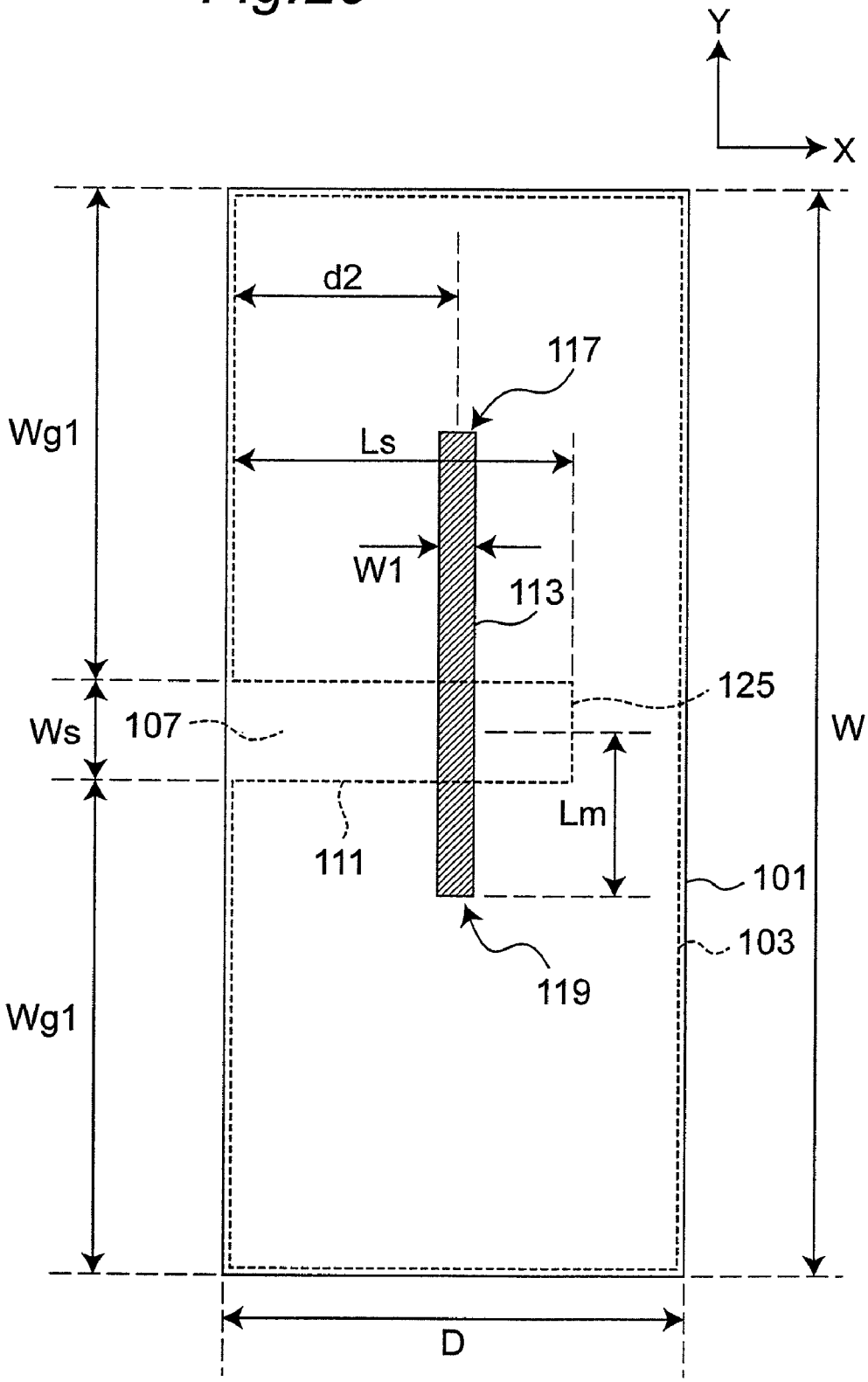
FIG. 20 is a schematic top view showing a structure of a slot antenna apparatus according to a first comparative example.

First, the characteristics were analyzed for three slot antenna apparatuses shown in FIGS. 18, 19, and 20, i.e., unbalanced-feed wideband slot antenna apparatuses of the first and second implementation examples of the present invention, and a slot antenna apparatus of the first comparative example. All conditions of substrates, except for the shape of an unbalanced feed line 113 and the shape of a grounding conductor 103, were the same for the implementation examples and the comparative example. In the first and second implementation examples and the first comparative example, an ideal unbalanced feed terminal 117 with 50Ω was set within an antenna substrate. In the first and second implementation examples, the resonant frequency of a stop band was adjusted by adjusting each slot length of one-end-open parasitic slot resonator 108*c*, 108*d*, 108*c*2, 108*d*2 for forming the stop band. In the first implementation example, the slot lengths of the parasitic slot resonators 108*c* and 108*d* were set to be equal to one-quarter effective wavelength for a frequency of 4.5 GHz. In the second implementation example, the parasitic slot resonators 108*c*2 and 108*d*2 were additionally provided to the grounding conductor structure of the first implementation example. The slot lengths of the parasitic slot resonators 108*c*2 and 108*d*2 were set to be equal to one-quarter effective wavelength for a frequency of 4.65 GHz. Respective grounding conductor widths Das2 between the parasitic slot resonator 108*c* and the parasitic slot resonator 108*c*2, and between the parasitic slot resonator 108*d* and the parasitic slot resonator 108*d*2 were set to 0.5 mm.

Figure 21:
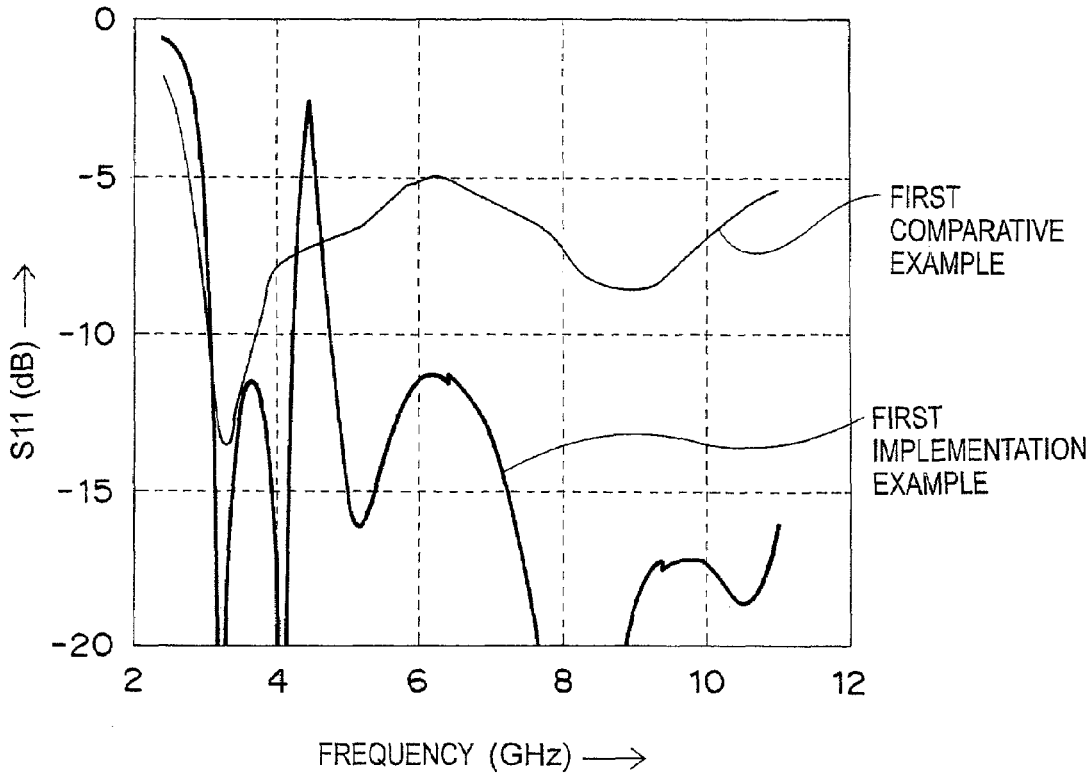
FIG. 21 is a graph of reflection loss characteristics versus frequency, for comparing between the first implementation example and the first comparative example.
Figure 22:
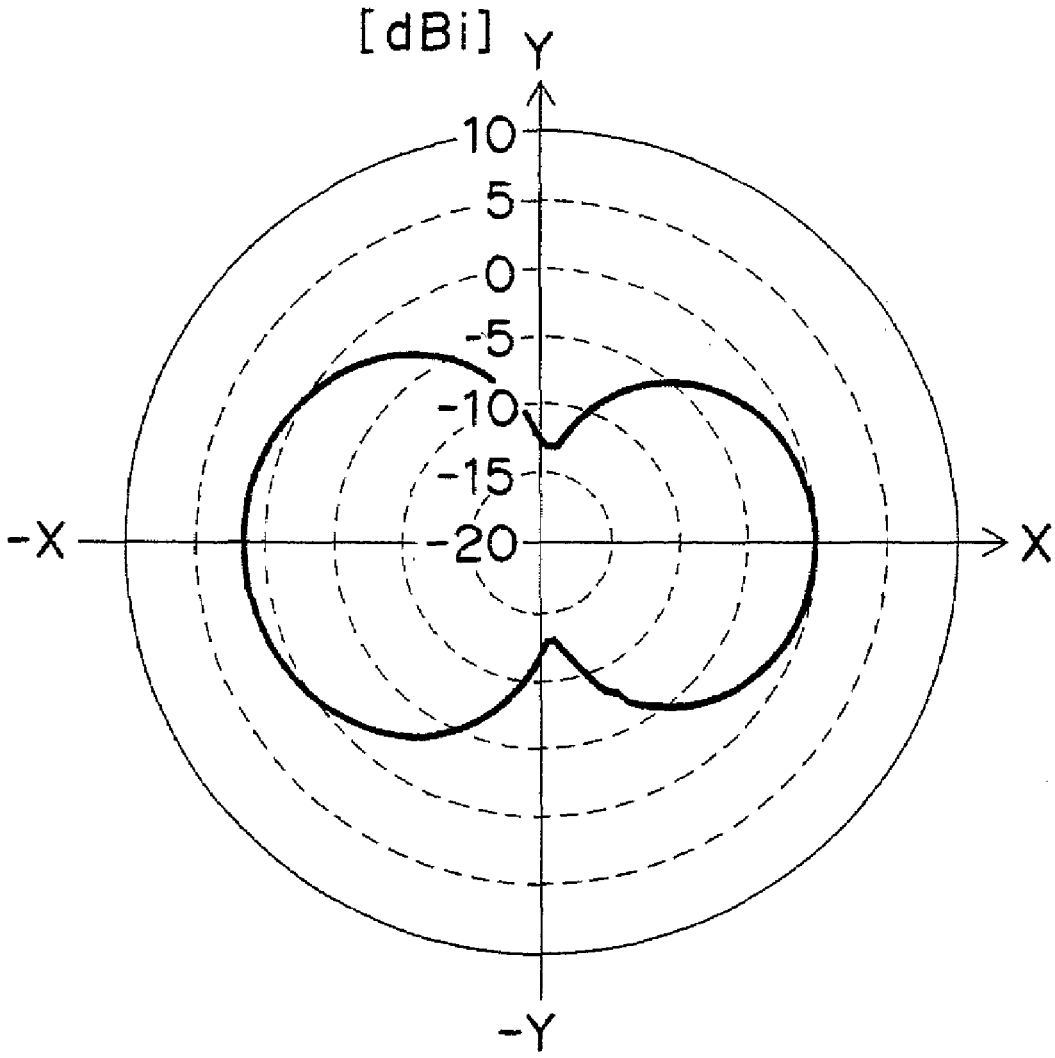
FIG. 22 is an E-plane radiation pattern diagram in the case that the first implementation example operates at a frequency of 3 GHz.
Figure 23:
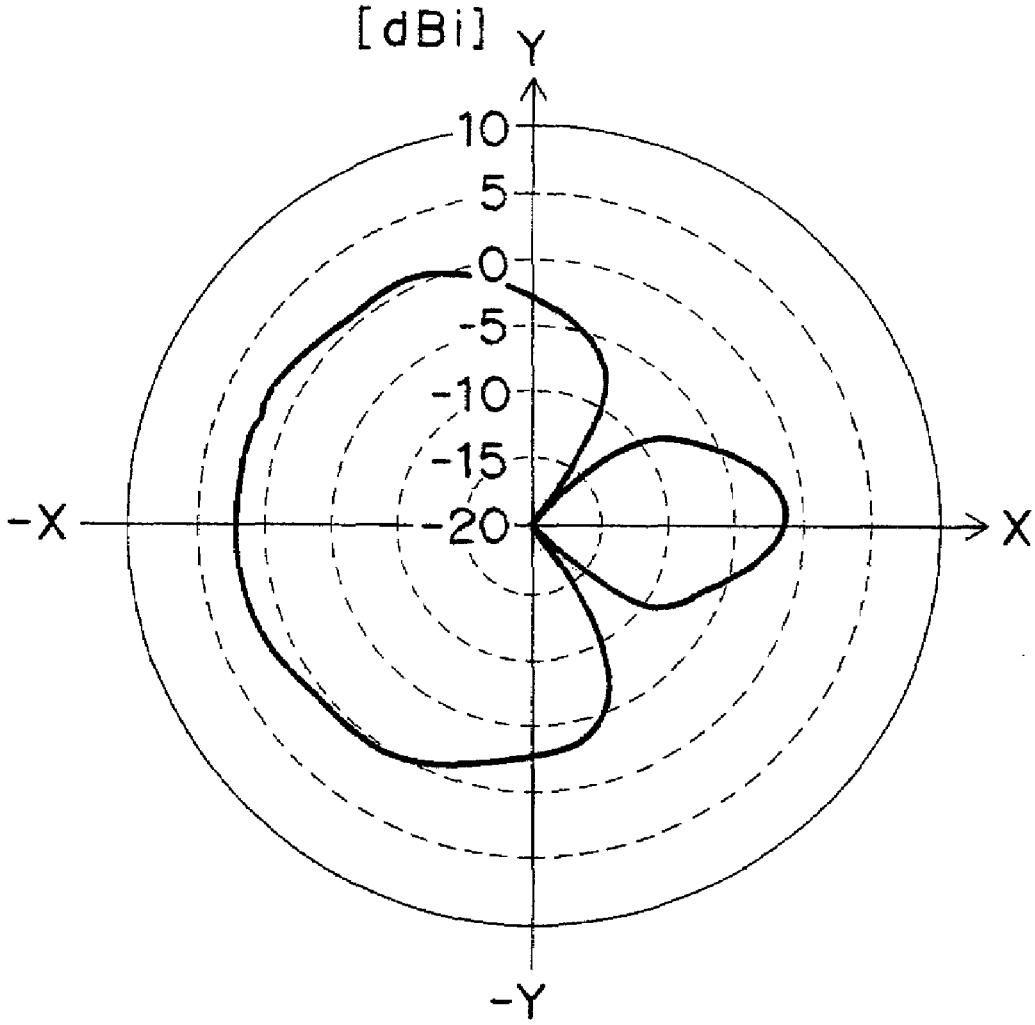
FIG. 23 is an E-plane radiation pattern diagram in the case that the first implementation example operates at a frequency of 7 GHz.
Figure 24:
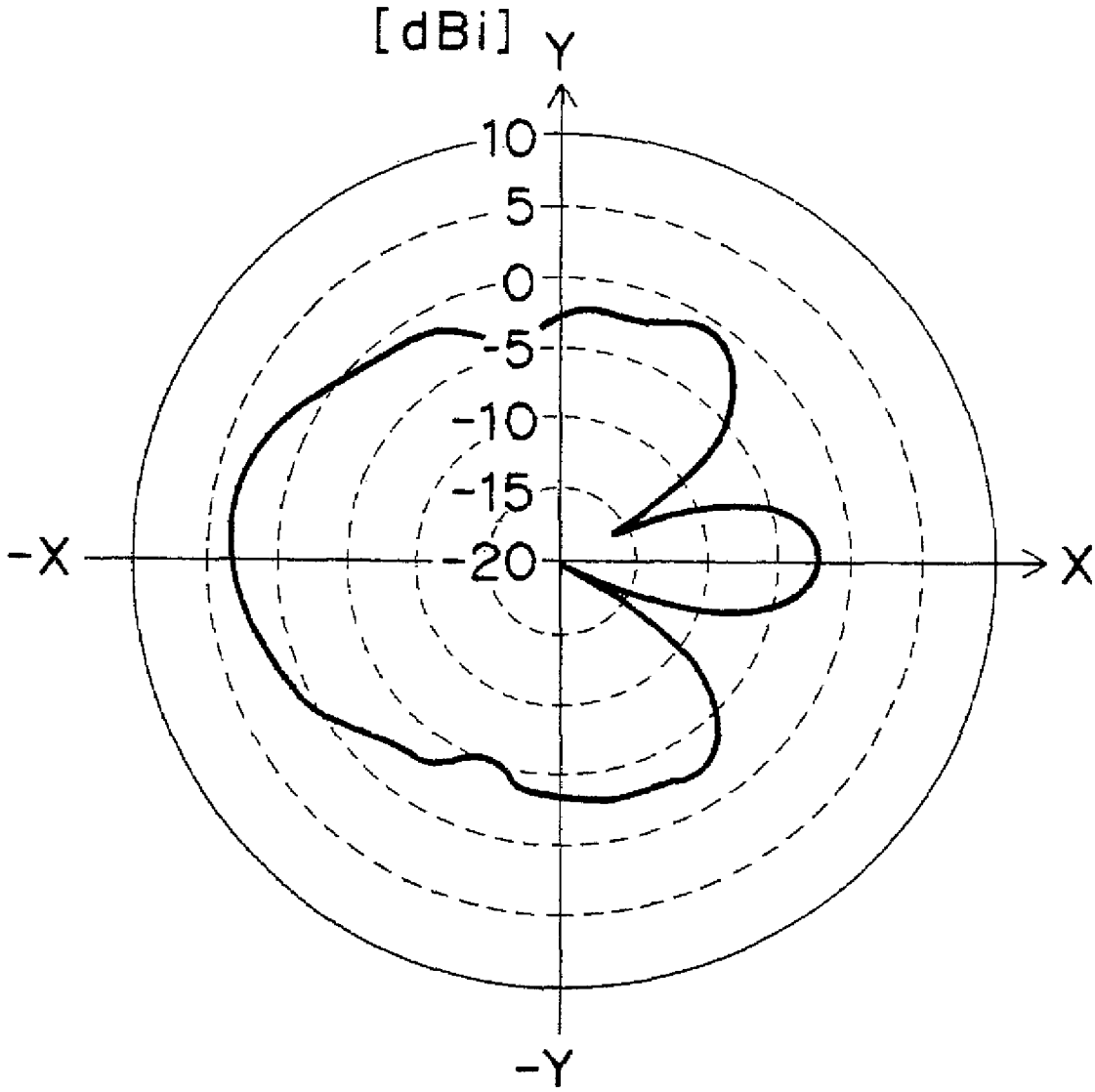
FIG. 24 is an E-plane radiation pattern diagram in the case that the first implementation example operates at a frequency of 10.6 GHz.
Figure 25:
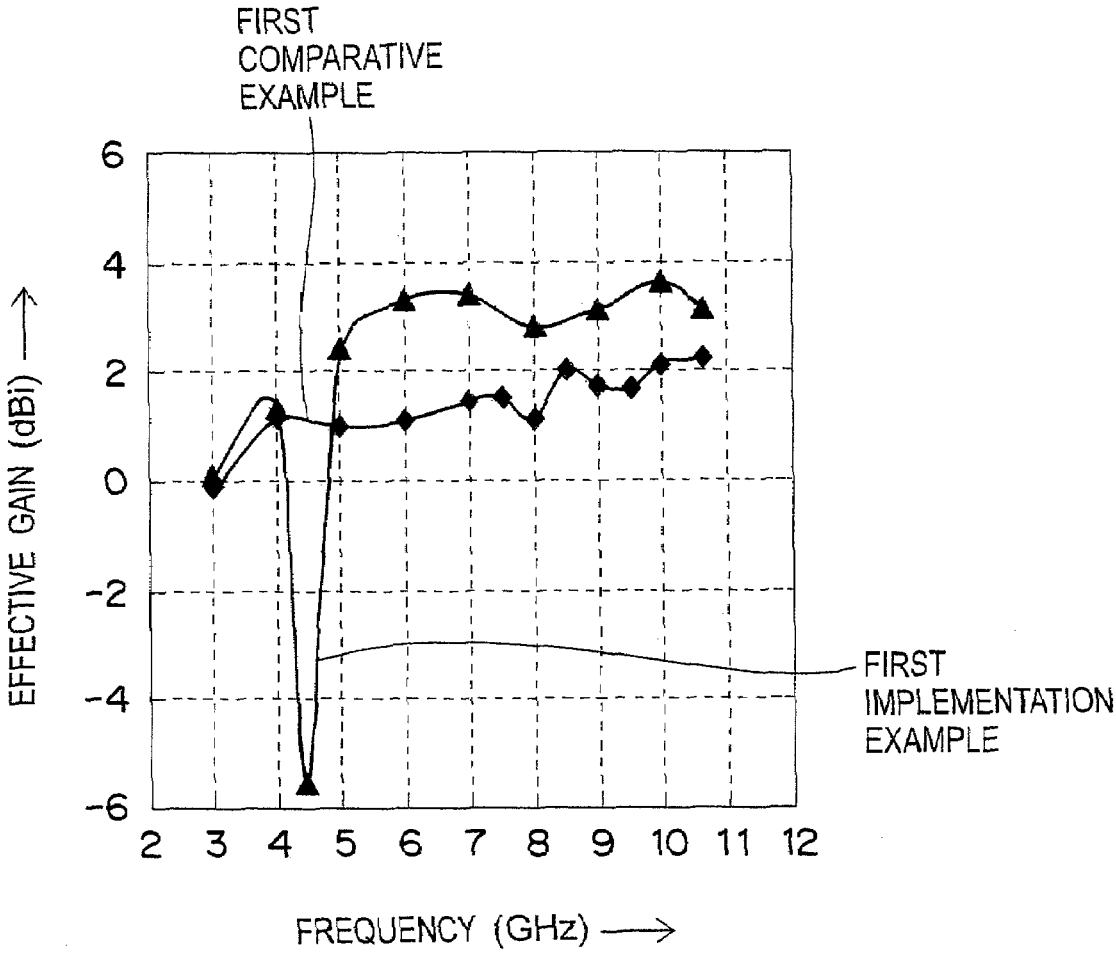
FIG. 25 is a graph of antenna effective gain versus frequency in a −X direction, for comparing between the first implementation example and the first comparative example.

A graph of FIG. 21 shows reflection loss characteristics versus frequency in comparison between the first implementation example and the first comparative example. In the first comparative example, in the range of 20% fractional bandwidth from 3.01 GHz to 3.69 GHz the reflection loss was less than −10 dB, and in the range from 2.88 GHz to 4.29 GHz the reflection loss was less than −7.5 dB, but at 6.1 GHz the reflection loss reached −4.8 dB, and thus wideband characteristics cannot be obtained. In addition, the operating band itself was narrow, and moreover, it was not possible to form a steep stop band in a partial band. On the other hand, the first implementation example simultaneously achieved a high reflection intensity in a partial band, and a low-reflection characteristic across an ultra-wideband frequency range excluding that band. More specifically, a good reflection characteristic was obtained, in which a reflection loss was equal to or less than −10 dB at a lower band from 2.98 GHz to 4.31 GHz and at a higher band from 4.77 GHz to 11 GHz. Besides, the reflection intensity was a high value equal to or more than −5 dB at frequencies from 4.36 GHz to 4.6 GHz, thus successively forming a stop band. At 4.49 GHz, a high reflection intensity of −2.7 dB was obtained. Further, as shown in FIGS. 22, 23, and 24 indicating E-plane radiation patterns in the cases that the first implementation example operated at frequencies of 3 GHz, 7 GHz, and 10.6 GHz, the first implementation example had the main beam always oriented in the forward direction (i.e., the −X direction) for the entire operating band, thus demonstrating superiority over printed monopoles of the prior art examples. A graph of FIG. 25 shows antenna effective gain versus frequency in the −X direction in comparison between the first implementation example and the first comparative example. Except for the stop band, the first implementation example exhibited a better gain than the first comparative example, thus demonstrating ultra-wideband low-reflection characteristics according to the preferred embodiments of the present invention. Additionally, the first implementation example achieved, in the stop band, a gain suppression of the extent of 8 dB as compared with adjacent bands, thus demonstrating an effect of the band-stop function in a partial band according to the preferred embodiments of the present invention.

Figure 26:
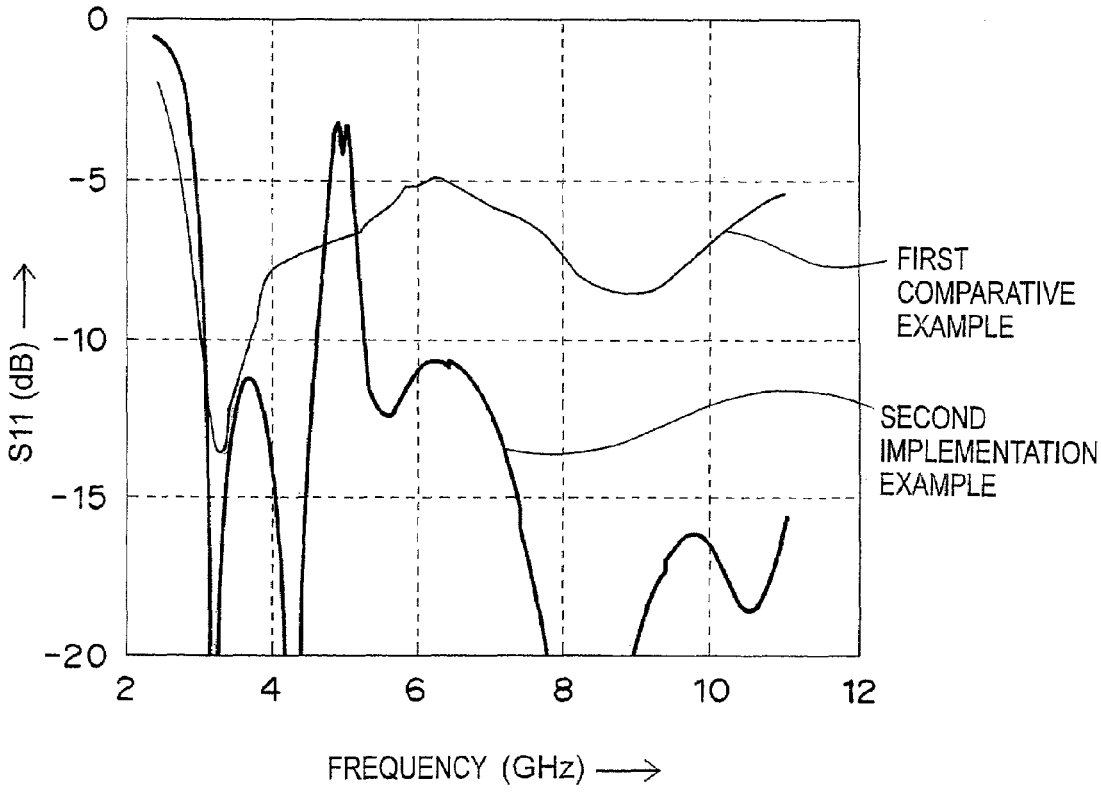
FIG. 26 is a graph of reflection loss characteristics versus frequency, for comparing between the second implementation example and the first comparative example.

A graph of FIG. 26 shows reflection loss characteristics versus frequency in comparison between the second implementation example and the first comparative example. The second implementation example simultaneously achieved a high reflection intensity in a partial band, and a low-reflection characteristic across an ultra-wideband frequency range excluding that band. At 4.49 GHz, a high reflection intensity of −2.7 dB was obtained. More specifically, a good reflection characteristic was obtained, in which a reflection loss was equal to or less than −10 dB at a lower band from 2.98 GHz to 4.64 GHz and at a higher band from 5.27 GHz to 11 GHz. Besides, the reflection intensity was a high value equal to or more than −5 dB at frequencies from 4.78 GHz to 5.18 GHz. Additionally, in the stop band, multiple resonance peaks were obtained, including −3.3 dB at 4.93 GHz, and −3.4 dB at 5.06 GHz. Although the band-stop function of the first implementation example relied on a single resonance characteristic and thus the stop band was narrow, the second implementation example achieved the extension of the stop band.

Figure 27:
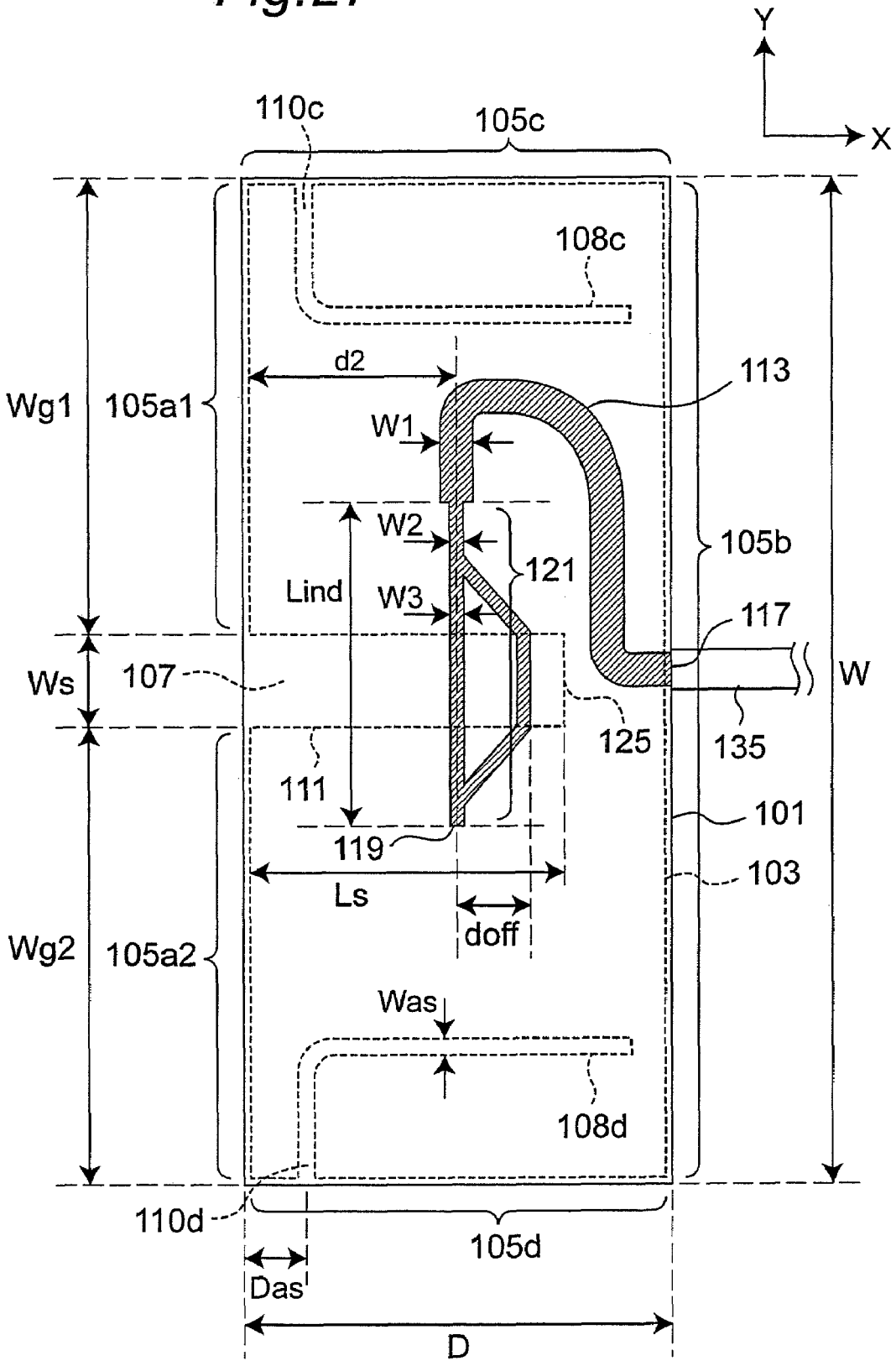
FIG. 27 is a schematic top view showing a structure of an unbalanced-feed wideband slot antenna apparatus according to a third implementation example of the present invention.
Figure 28:
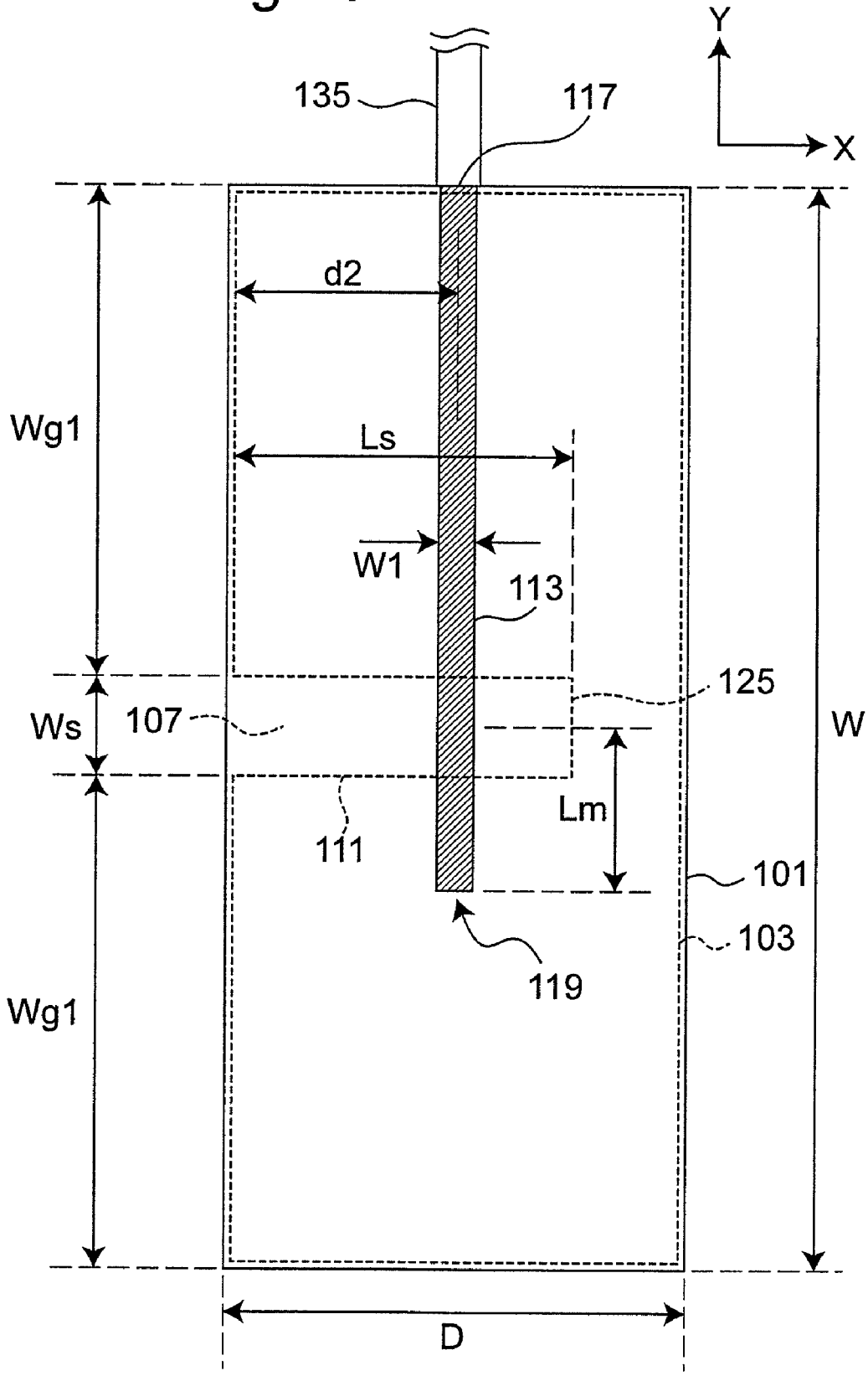
FIG. 28 is a schematic top view showing a structure of a slot antenna apparatus according to a second comparative example.

Furthermore, the characteristic were analyzed for an unbalanced-feed wideband slot antenna apparatus of the third implementation example of the present invention, and a slot antenna apparatus of the second comparative example, as shown in FIGS. 27 and 28, respectively. In the third implementation example and the second comparative example, it was assumed that a feed structure was provided, which established a connection between an antenna and a coaxial cable 135 through a coaxial connector (not shown) at a position indicated as an antenna feeding point 117 in the drawings. The third implementation example was configured in the same manner as the first and second implementation examples, except for an unbalanced feed line 113 and the feed structure. The second comparative example was configured in the same manner as the first comparative example, except for the feed structure. In analysis, first, assuming a coaxial cable length Lc of 150 mm, ideal feeding was done at an end of the coaxial cable 135. That is, the operation stability and wideband property of the antenna, including an influence on characteristics exerted by the coaxial cable 135 of the length Lc connected as an unbalanced feed circuit, were analyzed. Further, an analysis were performed at the same time, on the case of a coaxial cable length Lc of zero, i.e., the case in which ideal radio frequency feeding was assumed to be done at the antenna feeding point 117. In the second comparative example, since assuming no bend of the unbalanced feed line 113, the wiring direction of the coaxial cable 135 was in the Y-axis direction with reference to coordinate axes in the drawing. On the other hand, in the third implementation example, since the unbalanced feed line 113 was bent in the XY plane to be led to the antenna feeding point 117, the wiring direction of the coaxial cable 135 was in the X-axis direction in the drawing.

Figure 29:
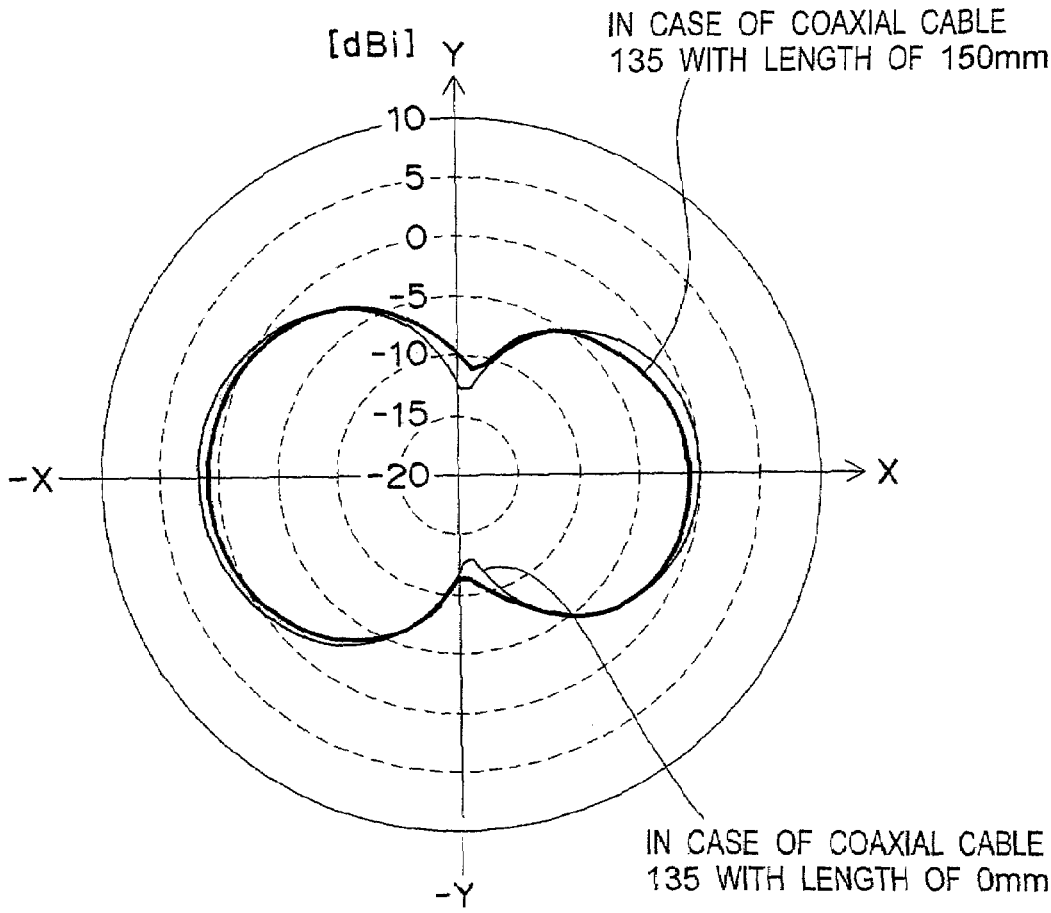
FIG. 29 is an E-plane radiation pattern diagram for the third implementation example at an operating frequency of 3 GHz, in cases of a coaxial cable 135 with length of 0 mm and with length of 150 mm.
Figure 30:
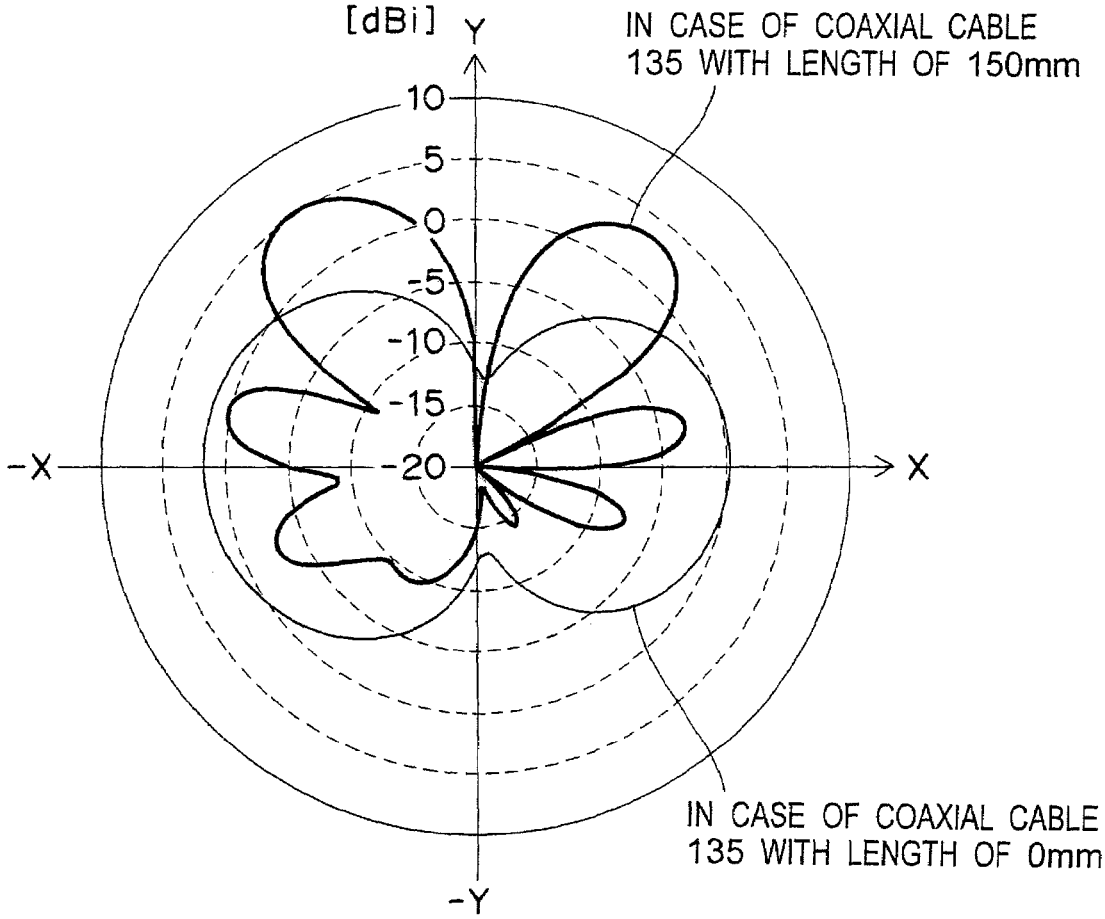
FIG. 30 is an E-plane radiation pattern diagram for the second comparative example at an operating frequency of 3 GHz, in cases of a coaxial cable 135 with length of 0 mm and with length of 150 mm.
Figure 31A:
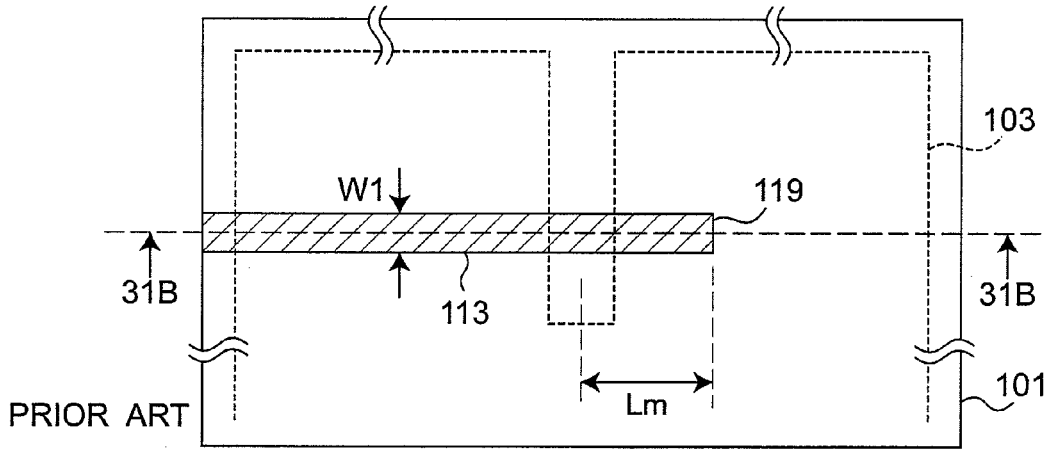
FIG. 31A is a schematic top view showing a structure of a typical one-quarter effective wavelength slot antenna (first prior art example)
Figure 31B:
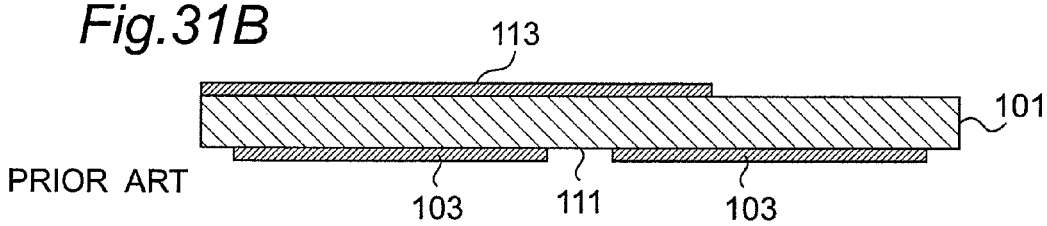
FIG. 31B is a schematic cross-sectional view along the dashed line in FIG. 31A.
Figure 31C:
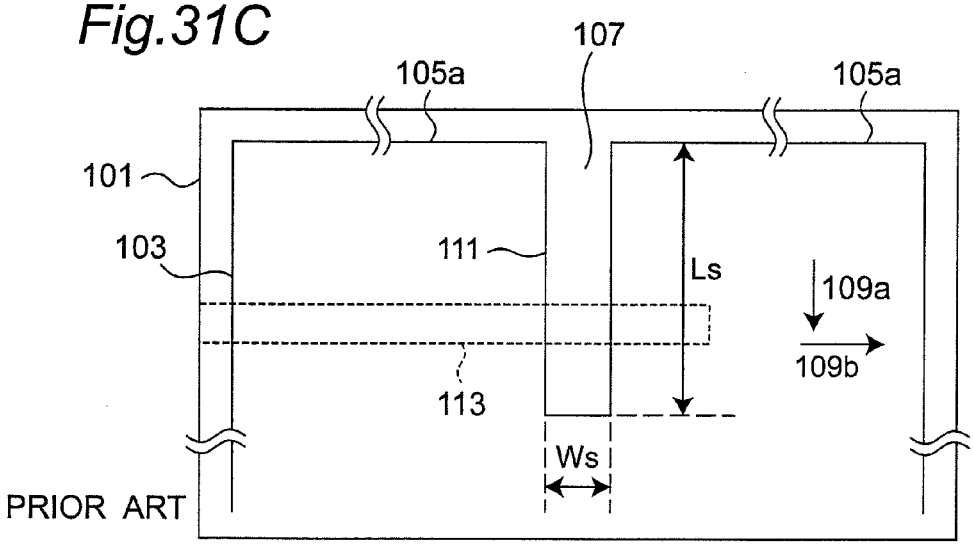
FIG. 31C is a schematic view showing a structure of a backside of the slot antenna in FIG. 31A by phantom.
Figure 32A:
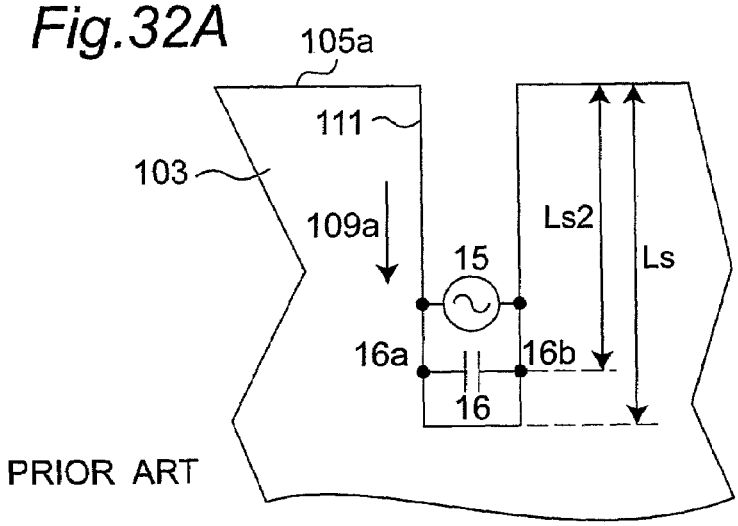
FIG. 32A is a schematic view showing a structure of a one-quarter effective wavelength slot antenna described in Patent Document 1 (second prior art example)
Figure 32B:
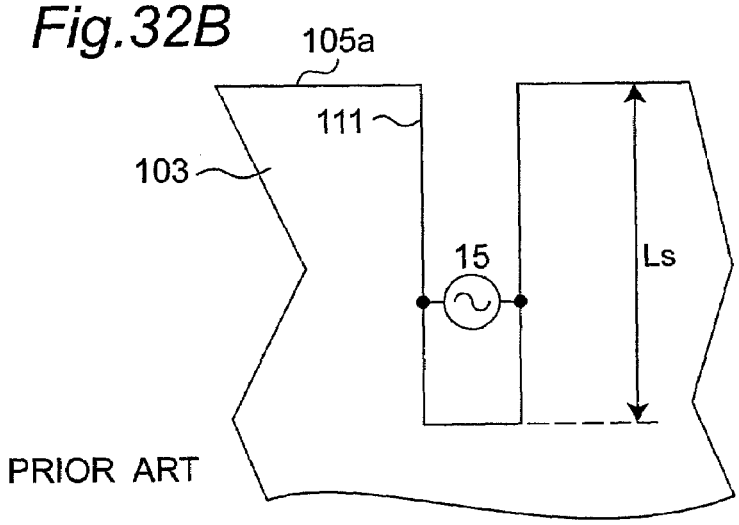
FIG. 32B is a schematic view showing the slot antenna in FIG. 32A when operating in a lower-frequency band.
Figure 32C:
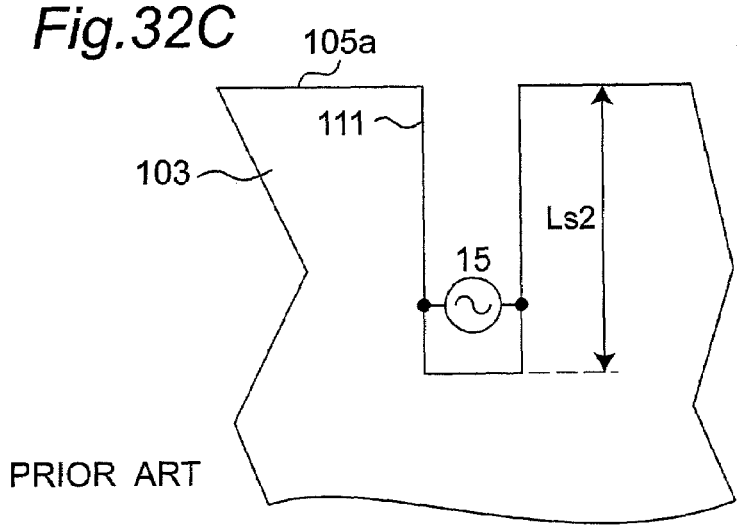
FIG. 32C is a schematic view showing the slot antenna in FIG. 32A when operating in a higher-frequency band.
Figure 33:
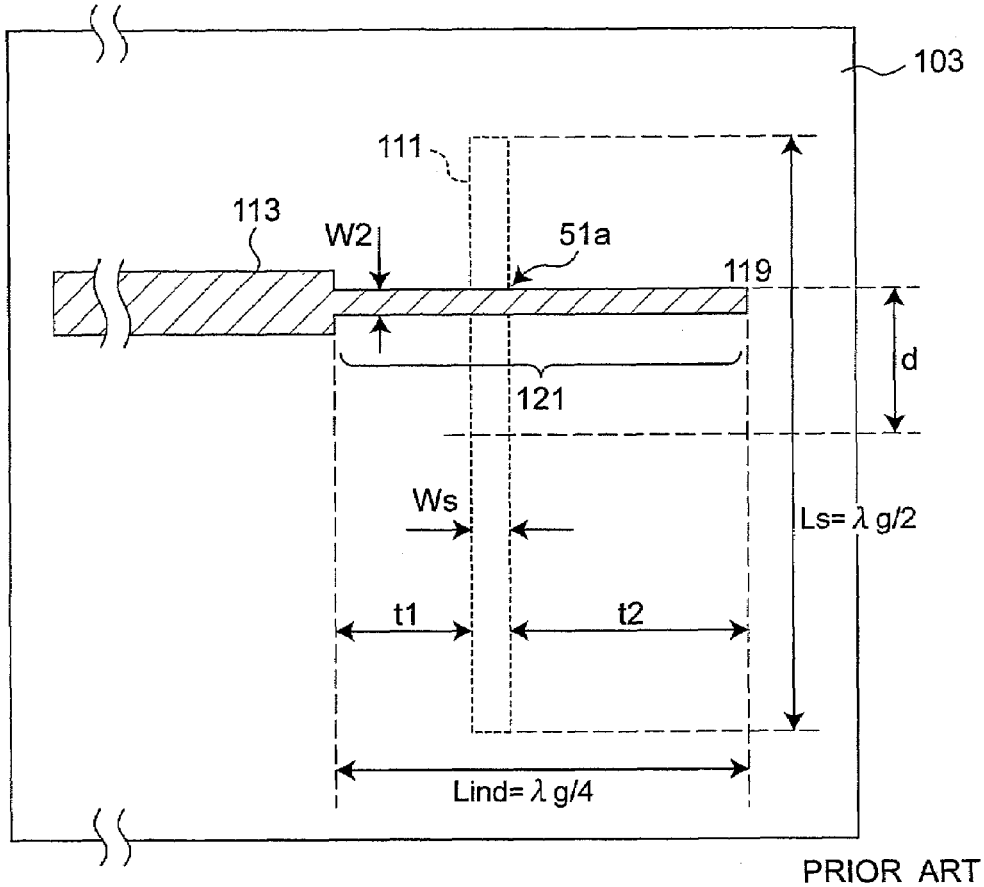
FIG. 33 is a schematic top view showing a structure of a slot antenna described in Non-Patent Document 1 (third prior art example)
Figure 34:
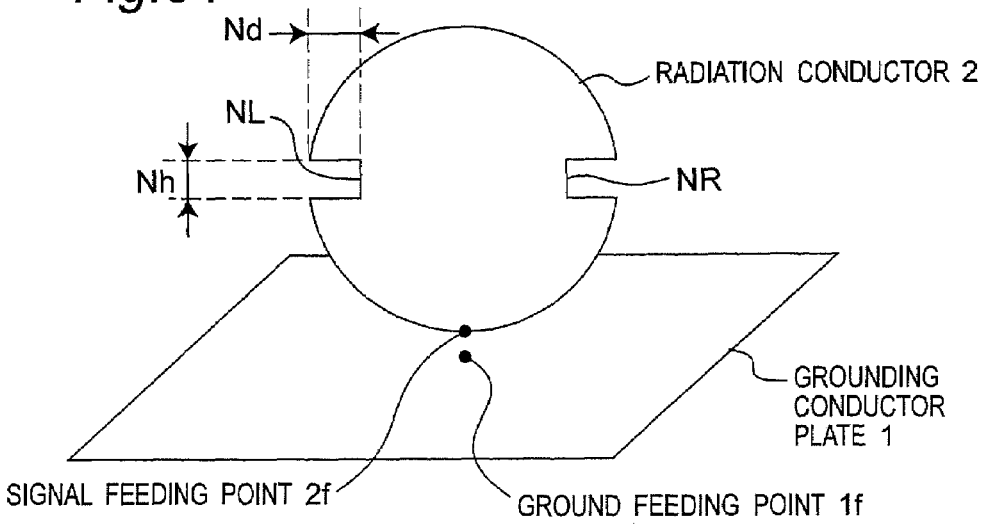
PRIOR ART Fig.34
FIG. 34 is a schematic view showing a structure of a wideband antenna apparatus described in Patent Document 2 (fifth prior art example).

FIG. 29 is an E-plane radiation pattern diagram for the third implementation example at an operating frequency of 3 GHz, in cases of the coaxial cable 135 with length of 0 mm and with length of 150 mm. The gain was set to an ideal gain value such that an influence of an input impedance mismatch was eliminated. Despite the fact that the grounding conductor 103 in the antenna was connected to the external circuit through the unbalanced terminal, stable radiation characteristics were maintained even in case of 150 mm. On the other hand, in the radiation characteristics of the second comparative example, it was observed that the characteristics tended to greatly change due to the influence of the coaxial cable 135. FIG. 30 is an E-plane radiation pattern diagram for the second comparative example at an operating frequency of 3 GHz, in cases of the coaxial cable 135 with length of 0 mm and with length of 150 mm. Due to a grounding conductor 103 in the antenna being connected to the external circuit through the unbalanced terminal, the radiation pattern in case of 150 mm was clearly disturbed by the influence of the coaxial cable 135.

As such, according to FIGS. 29 and 30, an advantageous effect of suppression of an unbalanced grounding conductor current, achieved by the preferred embodiments of the present invention, was demonstrated.

An unbalanced-feed wideband slot antenna apparatus according to the present invention can extend an impedance matching band without increasing an area occupied by circuitry and a manufacturing cost, and accordingly, it is possible to implement a high-functionality terminal with a simple configuration, which conventionally has not been able to be implemented unless multiple antennas are mounted. Also, the unbalanced-feed wideband slot antenna apparatus can contribute to implementation of a UWB system which uses a much wider frequency band than that of prior art apparatuses. In addition, since the operating band can be extended without using any chip component, the unbalanced-feed wideband slot antenna apparatus is also useful as an antenna tolerant to variations in manufacturing. Since the unbalanced-feed wideband slot antenna apparatus operates in the grounding conductor dipole antenna mode with the same polarization characteristics as the slot antenna mode, at frequencies lower than a frequency band of the slot antenna mode, the unbalanced-feed wideband slot antenna apparatus can be used as a small-sized wideband slot antenna apparatus. Also, in a system requiring ultra-wideband frequency characteristics, such as one that wirelessly transmits and receives a digital signal, the unbalanced-feed wideband slot antenna apparatus can be used as a small-sized antenna. In any case, when the unbalanced-feed wideband slot antenna apparatus is mounted on a terminal device, it is possible to always maintain the main beam direction in one same direction across an operating band. Since the unbalanced-feed wideband slot antenna apparatus eliminates the need to additionally install a filter for stopping a partial band to reduce interferences in frequency bands used by other communication systems, or significantly relaxes requirements for filter characteristics, some effects can be expected, such as a size reduction of a terminal, a reduction in cost, a reduction in insertion loss, expansion of communication areas, and saving in power. In addition, it is difficult for a filter element used in a UWB system to achieve ultra-wideband characteristics in a balanced circuit configuration, and accordingly, an industrial applicability of the present invention is very broad, in which the present invention achieves wideband characteristics while feeding in unbalanced manner.

As described above, although the present invention is described in detail with reference to preferred embodiments, the present invention is not limited to such embodiments. It will be obvious to those skilled in the art that numerous modified preferred embodiments and altered preferred embodiments are possible within the technical scope of the present invention as defined in the following appended claims.

What is claimed is:

1. A slot antenna apparatus comprising:

a grounding conductor, having an outer edge including a first portion facing a radiation direction, and a second portion other than the first portion;

a one-end-open feed slot formed in the grounding conductor along the radiation direction such that an open end is provided at a center of the first portion of the outer edge of the grounding conductor; and a feed line including a strip conductor close to the grounding conductor and intersecting with the feed slot at least a part thereof to feed a radio frequency signal to the feed slot, wherein the feed line is branched at a first point near the feed slot into a group of branch lines including at least two branch lines, and at least two branch lines among the group of branch lines are connected to each other at a second point near the feed slot and different from the first point, thereby forming at least one loop wiring line on the feed line, wherein a maximum value of respective loop lengths of the at least one loop wiring line is set to a length less than one effective wavelength at an upper limit frequency of an operating band, wherein branch lengths of all those branch lines among the group of branch lines, each branch line terminated at an open end and not forming a loop wiring line, are less than one-quarter effective wavelength at the upper limit frequency of the operating band, and wherein the slot antenna apparatus further comprises at least one one-end-open parasitic slot having an electrical length equivalent to one-quarter effective wavelength in a certain stop band, the parasitic slot having an open end at the second portion of the outer edge of the grounding conductor, and being formed in the grounding conductor so as not to intersect with the feed line.

2. The slot antenna apparatus as claimed in claim 1, wherein each loop wiring line intersects with boundaries between the feed slot and the grounding conductor, and the feed slot is excited at two or more points at which the boundaries intersect with the loop wiring line and which have different distances from the open end of the feed slot.

3. The slot antenna apparatus as claimed in claim 1, wherein the feed line is terminated at an open end, wherein a region of the feed line, extending from the open end over a length of one-quarter effective wavelength at a center frequency of the operating band, is configured as an inductive region with a characteristic impedance higher than 50 Ω, and wherein the feed line intersects with the feed slot at substantially a center of the inductive region.

4. The slot antenna apparatus as claimed in claim 1, wherein at the first portion of the outer edge of the grounding conductor, distances from the open end of the feed slot to both ends of the first portion of the outer edge are respectively set to a length greater than or equal to one-quarter effective wavelength at a resonant frequency of the feed slot, whereby the grounding conductor operates at a frequency lower than the resonant frequency of the feed slot.

5. The slot antenna apparatus as claimed in claim 1, wherein the grounding conductor is configured to be symmetric about an axis parallel to the radiation direction and passing through the feed slot, wherein the feed line is connected to a feeding point provided on a symmetry axis of the grounding conductor at the second portion of the outer edge of the grounding conductor, and wherein by being provided on the symmetry axis of the grounding conductor, the feeding point has an input and output impedance higher than an impedance in an unbalanced mode of the grounding conductor.

* * * * *